US010722807B2

(12) United States Patent
Smoot et al.

(10) Patent No.: US 10,722,807 B2
(45) **Date of Patent: *Jul. 28, 2020**

(54) HAPTIC FLOOR SYSTEM WITH QUAKE PLATE ASSEMBLIES PRODUCING LARGE VIBRATION EFFECTS

(71) Applicant: DISNEY ENTERPRISES, INC., Burbank, CA (US)

(72) Inventors: Lanny S. Smoot, Thousand Oaks, CA (US); David Loyal Christensen, Glendale, CA (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/597,956

(22) Filed: Oct. 10, 2019

(65) Prior Publication Data

US 2020/0038767 A1 Feb. 6, 2020

Related U.S. Application Data

(63) Continuation of application No. 16/015,506, filed on Jun. 22, 2018, now Pat. No. 10,456,694.

(51) Int. Cl.
*A63G 31/02* (2006.01)
*E04B 5/43* (2006.01)

(52) U.S. Cl.
CPC ..... *A63G 31/02* (2013.01); *E04B 5/43* (2013.01)

(58) Field of Classification Search
CPC ..... A63G 31/00; A63G 31/02; A63G 31/04; A63H 1/005; A63H 23/00; A63H 23/0458; G08B 6/00; G02B 15/00; G02B 15/14
USPC ..... 472/59–60, 135; 434/34, 55; 463/25, 42
See application file for complete search history.

(56) References Cited

U.S. PATENT DOCUMENTS

| | | | | |
|---|---|---|---|---|
| 6,159,100 | A | 12/2000 | Smith | |
| 6,270,414 | B2 | 8/2001 | Roelofs | |
| 7,938,751 | B2 | 5/2011 | Nicolas et al. | |
| 9,041,521 | B2 | 5/2015 | Cooperstock et al. | |
| 2004/0068211 | A1 | 4/2004 | Leivseth et al. | |
| 2013/0120861 | A1* | 5/2013 | Park | G02B 15/14 359/824 |
| 2017/0256145 | A1* | 9/2017 | Macours | H04N 5/2257 |

* cited by examiner

*Primary Examiner* — Kien T Nguyen
(74) *Attorney, Agent, or Firm* — Snell & Wilmer LLP; Kent A. Lembke

(57) ABSTRACT

A haptic floor system is provided that produces large vibration-based effects through the use of one-to-many panel or plate assemblies that can each be selectively operated by a controller in a programmed manner or in response to sensor outputs. Each of these panel or plate assemblies may be labeled a "quake plate assembly" as the special effect delivered by the haptic floor system can provide a person supported by one of the quake plate assemblies with ground trembling and vibrations similar to that felt in an earthquake or when a super strong fictional character strikes the floor nearby or a large animal or robot walks or runs by the person. Each quake plate assembly may include a thin plate or panel with an upper contact surface for supporting people or objects and an opposite lower surface, and one-to-many actuators may be provided on the lower surface of the thin plate.

20 Claims, 14 Drawing Sheets

HAPTIC FLOOR SYSTEM WITH QUAKE PLATE ASSEMBLIES PRODUCING LARGE VIBRATION EFFECTS

CROSS REFERENCE TO RELATED APPLICATIONS

This application is a continuation of U.S. patent application Ser. No. 16/015,506, filed Jun. 22, 2018, which is incorporated herein by reference in its entirety.

BACKGROUND

1. Field of the Description

The present description relates, in general, to techniques and systems for producing haptic feedback or effects to users of particular devices or to participants in an entertainment or other physical world experience. More particularly, the description relates to systems and methods for providing a floor or support platform that can be selectively vibrated to provide haptic feedback or a large haptic effect that can be experienced by people on the floor or support platform.

2. Relevant Background

There are many applications where it is desirable to provide people with new and surprising entertainment experiences. For example, theme and amusement parks are continuously searching for new ways to entertain their visitors and to draw in new visitors. Often, it is desirable for the experience to be immersive and hands on, and, if possible, it is desirable to deliver entertainment that is not available outside that particular theme or amusement park. Further, there is often a demand that the entertainment experience involves groups of participants who can interact with each other while they are all facing something new and unique.

For example, there is a demand for a physical world environment to be designed and built that can selectively provide people in that environment with haptic feedback in the form of a vibrating floor or ground. For example, the entertainment experience may involve placing the people in a space where one or more large animals or robots is moving nearby causing the ground to shake or vibrate (with few spaced-apart large vibrations or small vibrations occurring in more rapid succession), in a space where an earthquake or similar effect causes the floor/ground to shake, in a space where a superhero, a supervillain, or other large or strong character strikes or stamps on the floor/ground near the people causing the floor/ground to vibrate, or any other application where it is desirable to have the ground/floor shake to provide a desired haptic feedback.

Specifically, there is a demand for a floor surface that can provide rapid and strong haptic effects in the form of vibrations that can be sensed by people standing on the floor surface. Preferably, the floor surface would be designed to have a thin cross section and to support easy installation without extensive infrastructure (e.g., to support temporary as well as more permanent installations). Further, the floor surface with vibration haptic effects may need to be relatively inexpensive to fabricate and maintain to be more widely adopted.

SUMMARY

To address the above and other needs, a haptic floor system is provided that produces large vibration-based effects using one-to-many panel or plate assemblies that can each be selectively operated by a controller in a programmed manner or in response to sensor outputs. Each of these panel or plate assemblies may be labeled a "quake plate assembly" as the special effect delivered by the haptic floor system can provide a person supported by one of the quake plate assemblies with ground trembling and vibrations similar to that felt in an earthquake or when a super strong fictional character strikes the floor nearby or a large animal or robot walks or runs by the person.

For example, the sensors may include a motion (e.g., acceleration) sensor provided onboard (e.g., in each quake plate assembly) or in a prop or toy. The motion sensor(s) sends a wireless (or wired) signal to a receiver in the controller, which in response acts to instruct via a wireless (or wired) signal to one or more of the quake plate assemblies to create a shake that can be precisely coordinated with the measured motion/acceleration of the prop. The resulting vibration or shake may be a large magnification of the sensor output such as with a light tap of a large hammer, sword, club, hand, or the like on a panel/tile contact surface causing people standing on the floor to experience what would happen if a large object was slammed against the floor near them and a larger strike of the object might be earthquake-like. In another example, the sensors may include accelerometers mounted in a performer or participant's shoes, and, in this case, each footfall of the performer/participant on or near a quake plate assembly may be sensed and responded to by the controller to operate quake plate assemblies to create large and very powerful shaking sensations. In another example, a video may show an event such as a herd of animals running by the people on the quake plate assemblies, and the controller may coordinate operation of the quake plate assemblies to lightly vibrate the panels/plates/tiles when the herd is farther away and to more vigorously vibrate the panels/plates/tiles when the herd in shown to be nearer to the people's location.

To this end, an initial problem to be solved is to create an extremely thin cross-section floor surface for strong effects and easy installation without extensive infrastructure, e.g., a haptic floor system that can be used even for temporary events. Each quake plate assembly may include a thin plate or panel with an upper contact surface for supporting people or objects and an opposite lower surface, and one-to-many actuators may be provided on (or in contact with) the lower surface of the thin plate (or panel). In one embodiment, for example, the actuators are a large number (e.g., in the range of 10 to 100 depending on the size of the plate/panel and desired haptic effect) of small vibrator motors each with an eccentric mass (hence, often called eccentric rotating mass (ERM) actuators). The eccentric masses can be synchronized or aligned to have similar orientations using gravity, and a large haptic effect (or shaking/vibrating of the plate/panel/tile) is provided by simultaneous or concurrent rotation of these many eccentric masses by operation of the vibrator motors by the controller. Prototyping with this actuation design was highly successful and well received by participants.

The inventors generated additional quake plate assembly designs in response to demands for long lifetimes, easy maintenance, and low fabrication costs. The inventors recognized that to maintain the low cost of the above-described prototype design that the actuation can be provided with fewer, larger motors but a simple scale up may result in less immersive and slower behavior. Additionally, the inventors determined it may be useful in some embodiments to transition away from the brushed direct current (DC) motors used in the small vibrator embodiment as these can be a point of failure during durability testing. Many haptic effects are largely impulsive such that they take a very large instantaneous rush of current. To make installations of the haptic floor system more practical, the inventors designed custom drive circuits and a local charge storage bank for each quake plate assembly such that the power demands on the infrastructure and overall power supply were reduced, with some embodiments seeing a reduction by more than a factor of ten, as was the diameter of the cable powering each quake plate assembly (with the area of the cable/wire decreasing by a factor of ten with its diameter dropping by up to the square root of ten).

The first embodiment was generated for use in virtual reality (VR)-style experiences, but it and other uses of the haptic floor system were to make larger-than-life experiences (with or without VR hardware and software). This can involve obtaining measurements of physical events in the real world (e.g., size and speed of vibration of a plate and the like) and playing these measured events back in their appropriate larger-than-life incarnations. The controller may also be programmed to concurrently trigger other elements of the haptic floor system such as effects elements to make the experience more immersive such as with video equipment to provide a video "quake," lighting equipment to strobe lightening or other light-based effects, and sound equipment to provide sound effects corresponding to the vibration-causing event.

A second useful embodiment was designed by the inventors using modified quake plate assemblies. In this embodiment, the motor size was scaled up by more than a factor of ten and used low-cost, mass-produced, brushless motors that will likely last many times longer than the brushed motors used in the first embodiment. By choosing a very specific and special geometry for an eccentric mass actuator or "shaker" (e.g., one with an extremely long and narrow offset or eccentric mass instead of a wedge-shaped one as in the first embodiment), the inventors were able to maintain the same, or greater, range of vibration effects despite using far fewer motors (two, four, six, or the like). This design was optimized for both assembly and maintenance. Motor installations or swaps should take minutes. By allowing for a motor on each end of the drive or rotation shaft and elongated, eccentric mass provided on (and extending along) this shaft (in some implementations of this embodiment), the design can even be very simply redundant for increased performance or to ensure a quality haptic experience while coupling vibrations to the plate at many locations for a more uniform feel. Since both motors of the actuator are directly coupled to the same drive shaft (and attached eccentric mass), there is no need to worry about synchronization. Overall this solves durability and reliability concerns while maintaining the attractive low profile and low cost nature of the haptic floor system and also while improving manufacturing and maintenance costs.

More particularly, a haptic floor system is provided that is adapted to provide a vibration-based haptic experience. The system includes a master or show controller and a plurality of quake plate assemblies. Each of the quake plate assemblies includes a plate or panel with an upper contact surface and a lower mounting surface opposite the upper contact surface and at least one actuator mounted on the lower mounting surface and operable to apply forces to the plate to cause the upper contact surface to vibrate. During operations, in response to a sensed event, the master controller generates and transmits control signals to the plurality of quake plate assemblies to independently trigger operations of the at least one actuator of each of the quake plate assemblies to sequentially or concurrently operate to apply the forces to concurrently or sequentially vibrate the upper contact surfaces of the plurality of quake plate assemblies.

The system may further employ a sensor sensing and generating sensor output in response to at least one of the following: movement of a person relative to the upper contact surfaces; movement of a prop relative to the upper contact surfaces; and contact of an object with one of the upper contact surfaces. The master controller processes the sensor output to identify the sensed event and generate/trigger the control signals. Each of the quake plate assemblies may include a local controller and memory storing a library of haptic effect definitions, and the local controller, in response to receipt of one of the control signals, retrieves one of the haptic effect definitions and operates the actuator to apply the forces to the plate. In some embodiments, the sensed event is a display playing a video or an audio system playing a soundtrack, and the actuators are operated based on a haptic event script or set of code associated with the video or the soundtrack to provide a haptic experience matched to the video or the soundtrack.

In some embodiments, the actuator includes a plurality of vibrator motors each with a drive motor, a drive shaft rotated by the drive motor, and a weight affixed to the drive shaft with a center of mass offset a distance from a central axis of the drive shaft, whereby each of the vibrator motors generates a centrifugal force during operations of the drive motor. In practice, centrifugal force is the force one feels when the actuator is spinning with a steady state velocity, but, in many cases, the actuator devices are operated in a mode where centrifugal is not the most important force, e.g., if the weights simply go back and forth rapidly with a small angle pendulum motion, then it is almost entirely a simple acceleration of the mass side to side the person on the haptic plates/tiles are feeling. Hence, it may be useful for this specification for the term "centrifugal force" to mean either centrifugal (steady state) or combined other transient accelerative forces the weight undergoes.

Each of the quake plate assemblies can include second and third ones of the actuators, a driver for each of the actuators, and an onboard power storage for operating the drive motors, and the actuators on each of the quake plate assemblies can be independently operable via the drive motors to achieve desired vibratory effects. The actuator may also include a linear frame supporting the plurality of vibrator motors with the drive shafts arranged to be parallel, and the frame is rigidly coupled to the lower mounting surface with the plate being a planar sheet of rigid material (e.g., 0.25 to 0.5-inch thick aluminum waffle plate or the like). In some implementations, the drive motors are operated in short bursts to provide gravity-based synchronization of orientations of the weights or is operated to rotate the drive shaft in alternating directions to move the weights with pendulum motion.

In other embodiments, the actuator of each of the quake plate assemblies includes an elongated drive shaft extending parallel to the lower mounting surface, at least one drive motor operable to rotate the elongated drive shaft, and an elongated weight rigidly coupled to the elongated drive shaft and extending parallel to the elongated drive shaft with a central axis offset a distance from a central axis of the elongated drive shaft.

DETAILED DESCRIPTION

Briefly, the following description provides a haptic floor system that includes one-to-many quake plate assemblies (or, more simply, plate (or tile or panel) assemblies) that provide a thin, modular, and scalable floor-tile system operable to achieve a powerful haptic vibration effect. The plate assemblies can easily be installed over unprepared floor surfaces or ground surfaces that are roughly level. The simplicity of installation and lack of extensive support infrastructure allows for use at temporary events or applications as well as for use in more permanent installations. Each quake plate assembly can be powered with onboard batteries that last all day or longer on a charge or may be wired to a power source in more permanent settings.

Figure 1:
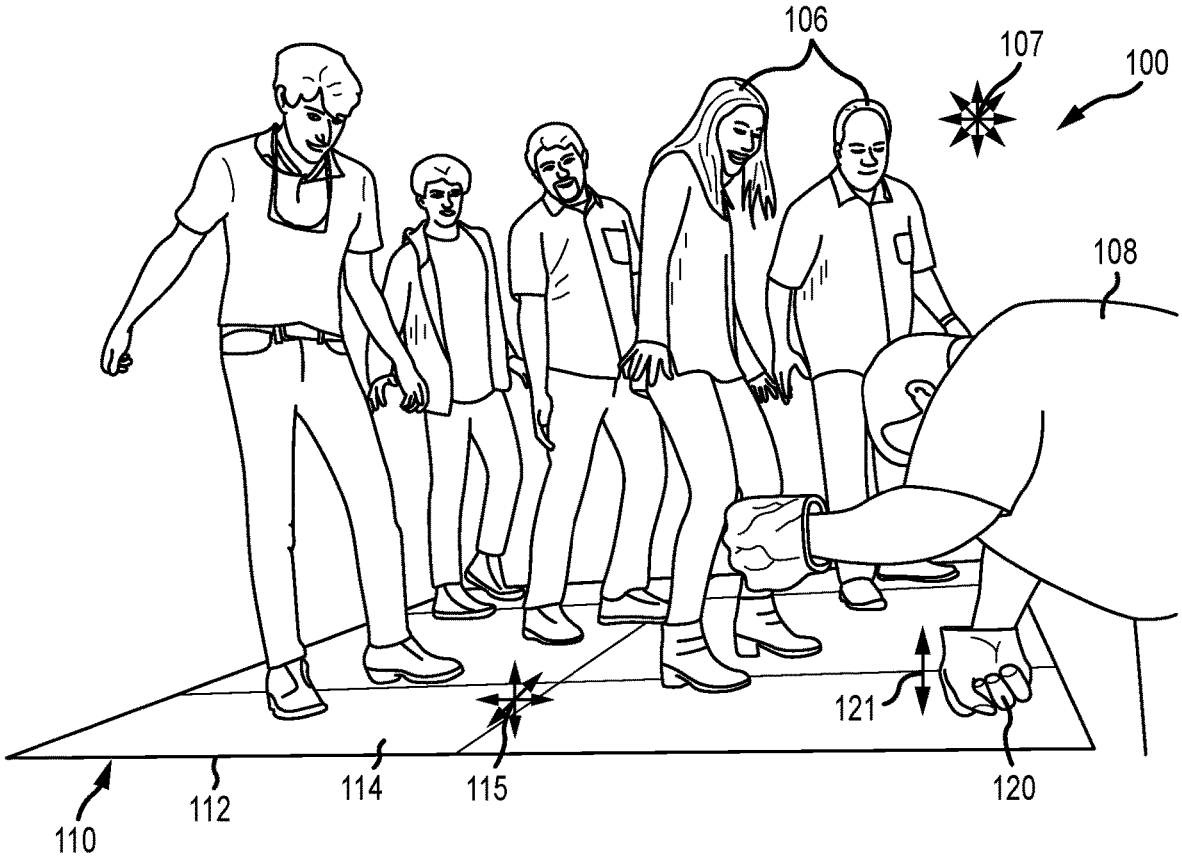
FIG. 1 is a top perspective view of a portion of a haptic floor system during its use or operation to provide a vibration-based haptic experience to a plurality of people or users.

FIG. 1 illustrates one prototyped haptic floor system 100 during its use or operation to provide a vibration-based haptic experience to a plurality of people or users (or participants) 106. As shown, the system 100 includes a plurality of quake plate assemblies 110 tiled together to provide a floor or support platform, and participants 106 are positioned to be standing upon or otherwise supported by the floor/support platform of the system 100. More specifically, each of the quake plate assemblies 110 includes a thin panel 112 with an upper contact surface 114, and the participants 106 stand upon these surfaces 114.

When an assembly 110 is actuated by its one-to-many actuators mounted on the lower surfaces of the thin panel 112, the panel 112 including the upper contact surface 114 is caused to vibrate as shown with arrows 115 (e.g., movement in the X, Y, and/or Z directions). As a result, the participants 106 are also vibrated as shown with arrows 107 to have a vibration-based haptic experience. The haptic floor system 100 also includes one or more input objects or props (or toys or the like) 120 that may be moved relative to the quake plate assemblies 110 (as shown with arrows 121) such as to strike one of the upper contact surfaces 114 as shown in FIG. 1 by an operator (e.g., an actor or another participant) 120. A sensor in the prop/input object 120 (or elsewhere such as in the panel 112) is used by a controller of the system 100 to sense when contact with the surface 114 occurs (and, in some cases, the strength or magnitude of this strike/contact event), and, in response to the processing of the sensor output, the controller operates the actuator or actuators of one or more of the quake plate assemblies 110 to vibrate 115 the panel 112 and its upper contact surface 114.

Testing with the prototype of the system 100 proved that high strength vibrations under people's feet can provide surprising immersive experiences for the participants/system users 106. Initial prototypes used a large array of small vibrator motors synchronized for added impact, but planned implementations likely may use embodiments taught herein (and also prototyped) with a very small number of much higher power motors using an innovative new reaction or eccentric/offset weight design to maintain quality and cost despite its increased size. Such embodiments with smaller numbers of higher power motors providing the actuators may be more robust in long term installations, are designed for reliability and serviceability, and maintain the same low up-front build costs by using mostly off-the-shelf parts. Vibration strength is often enhanced as well in such embodiments. On the electronics side of the design, a special motor driver was developed to drive the longer-life, brushless motors, of the embodiments using fewer higher power motors, with the high frequency response found more desirable in most embodiments. The use of large capacitors was also investigated in the prototype designs and appears promising as a way of reducing power supply requirements.

Some applications may allow or require use of smaller quake plate assemblies such as in park ride or gamer seats or may allow for or even demand higher fidelity. For such applications, a quake plate assembly considered "high definition" or "HD" may be utilized that the inventors designed using low-profile haptic actuators. For example, high-power audio amplifiers may be used as or in the actuators of a panel/plate/tile where the implementations call for complete control of the haptic effect or where the panel's contact surface is relatively small.

Figure 2:
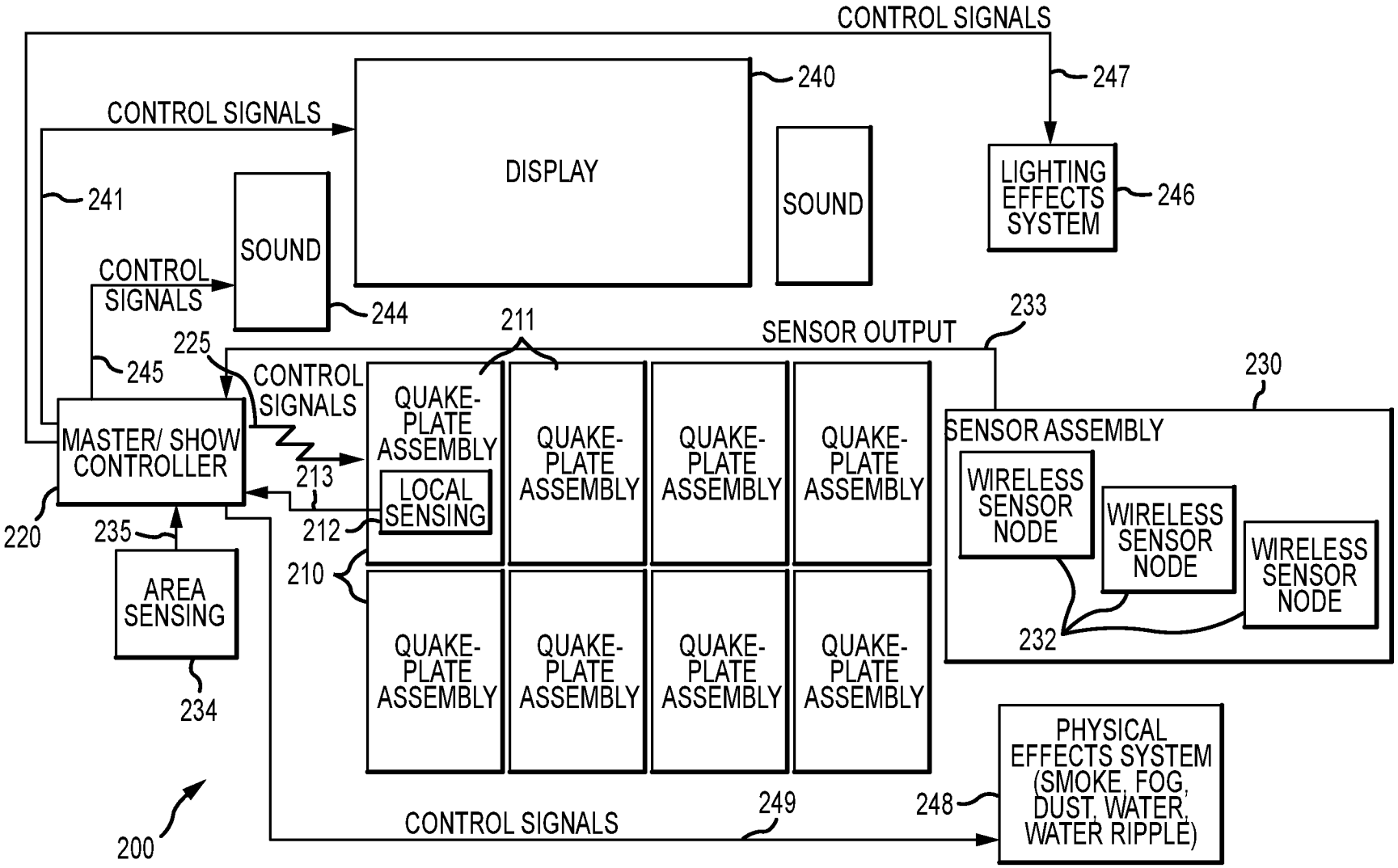
FIG. 2 is a functional block diagram of a haptic floor system of the present description.

FIG. 2 illustrates a haptic floor system 200 of the present description that is useful for providing participants or users of the system 200 with a vibration-based haptic experience. The system 200 includes a plurality of quake plate assemblies 210 each with upper contact surfaces 211 (of panels, plates, or tiles) arranged to be proximate to each other in a tiled arrangement to provide a support platform or flooring for a space to support users/participants or to provide a portion of a seat or the like that would be in contact with a portion of a user's body.

As discussed with reference to FIG. 1, each of the quake plate assemblies 210 is operable via control signals 225 to operate to vibrate the panel/plate to cause the upper contact surface 211 to vibrate to provide haptic feedback. The master/show controller 220 may include one or more processors/computing devices running code or executable instructions (control software or running a control program) to process sensor outputs and, in response, to generate the control signals 225 to trigger operation of one or more actuators in all or a subset of the quake plate assemblies 210 to vibrate the surfaces 211. In some embodiments, the control signals 225 may vary the magnitude of the vibrations provided on surfaces 211 as well as the timing of such vibrations and the signals 225 may be generated by playback of predefined vibratory effect (e.g., by running one or more haptic experience programs that may or may not rely on sensory input such as to provide synchronization with displayed video and/or sound or other effects).

The system 200 includes one or more sensors whose outputs the controller 220 may process to trigger the control signals 225. In this regard, the system 200 is shown to include local sensing/sensors 212 on one or more of the quake plate assemblies 210, and these sensors 212 can operate as shown at 213 to provide sensed data or sensor output to the controller 220. The local sensing/sensors 212 may include maintenance sensing and/or local show sensing (such as to indicate when the surface 211 is struck by an object or when an object is moved into proximity with the surface 211).

The system 200 also includes a sensor assembly 230 with one or more (three shown as a non-limiting example) wireless sensor nodes 232 that are useful for gathering sensory information and communicating as shown at 233 the gathered sensory data to the controller 220 for processing and, in response, generating the control signals 225. For example, the wireless sensor nodes 232 may be mounted on or within user input objects (e.g., prop, toys, game-playing devices, and the like) to sense movement of these objects relative to the contact surfaces 211, with a useful example being an accelerometer provided in an object that an operator uses to strike the contact surface 211 with the controller 220 identifying when the strike occurs and at what speed/magnitude of force and responding with control signals 225 to initiate operation of actuators of the quake plate assemblies 210 to cause the surfaces 211 of panels/tiles to vibrate. Area sensing/sensors 234 may also be included to collect more general data in the space proximate to the surfaces 211 such as the location and/or movement of users/operators on the quake plate assemblies, and this data is communicated as shown at 235 to the controller 220 for processing and, in response, generating the control signals 225.

The operations of the quake plate assemblies 210 in the system 200 is coordinated in some embodiments by the master/show controller 220 with operations of other components of the system 200 to achieve an immersive haptic experience. Particularly, the controller 220 may generate the vibration-initiating signals 225 concurrently with or in a synchronized manner with control signals 241 to a display 240 so as to have the vibrations provided by surfaces 211 suit a video sequence on the display 240, e.g., a stampede of elephants causing the flooring provided by the tiled surfaces 211 to vibrate violently. The vibrations may also be coordinated with sound effects or soundtracks played by the sound components (e.g., speakers and the like) 244 with control signals 245 from the controller 220, e.g., sounds of trumpeting elephants along with the soundtrack from a herd of elephants. The vibrations may also be coordinated with lighting effects from lighting effects system 246 operated with control signals 247 from the controller, e.g., vibrating the surfaces 211 in conjunction with lightning flashes simulated by system 246. The vibrations may further be coordinated with other effects by the controller transmitting control signals 249 to a physical effects system 248, e.g., to provide smoke, fog, dust, water spray or movement, or the like as may be expected in an environment being displayed in the video on display 240 (e.g., dust associated with stampeding elephants).

Figure 3:
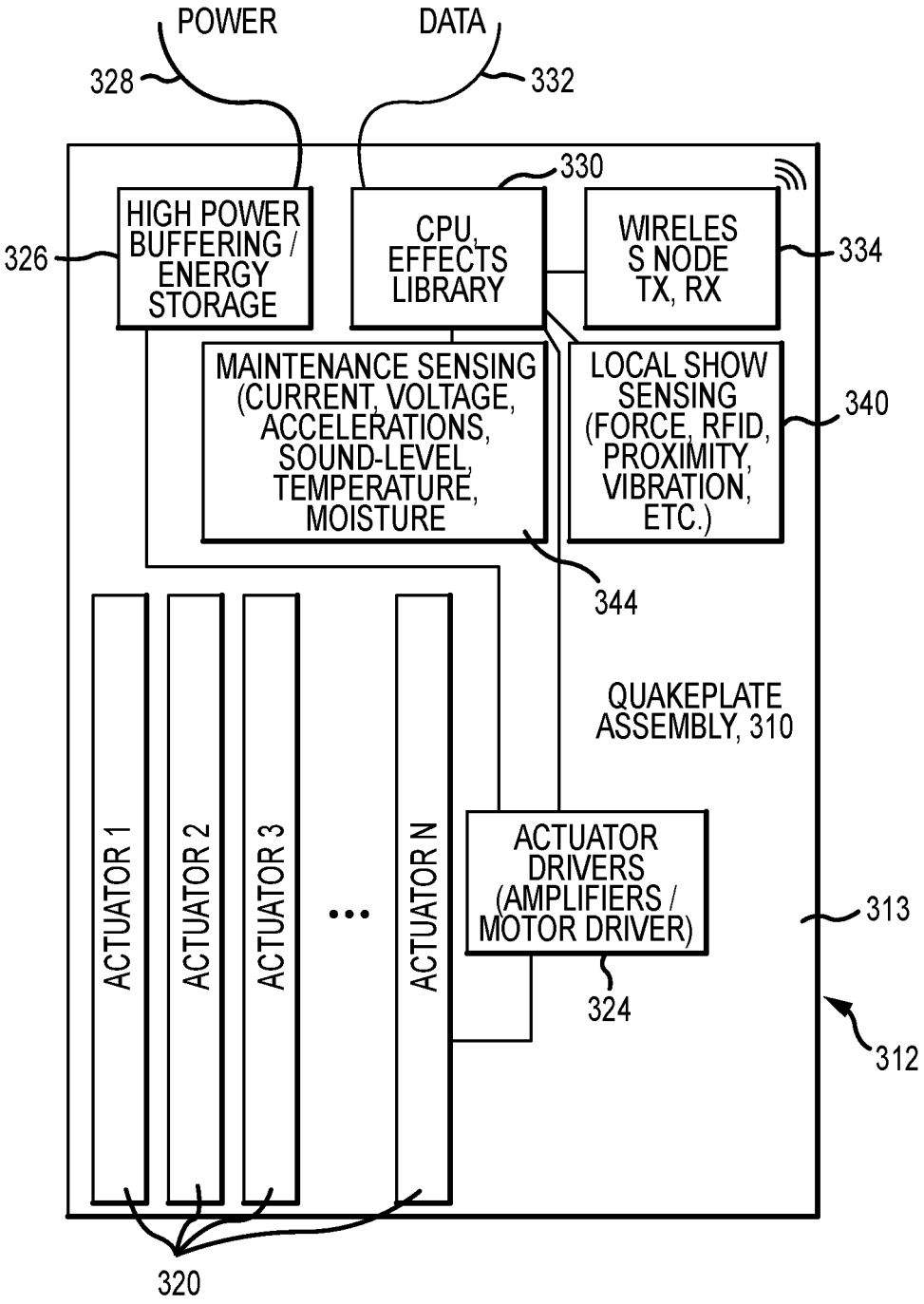
FIG. 3 is a functional block diagram of a single quake plate assembly viewed from its underside or looking at its bottom or lower surface (opposite an upper contact surface)

FIG. 3 is a functional block diagram of a quake plate assembly that may be used in a haptic floor system of the present description (such as for assembly 110 in FIG. 1 or assembly 210 in FIG. 2). The assembly includes a thin plate (or panel or tile) 312 with a lower or mounting surface 313, which would be opposite to an upper or contact surface used for supporting or abutting a person to provide a vibration-based haptic experience to that person. As shown, the assembly includes one or more actuators 320 mounted upon or affixed to the lower or mounting surface 313 of the panel, and the actuators 320 are typically concurrently operated (e.g., in response to control signals from an offboard controller) by actuator drivers 324, which may include one or more amplifiers and/or motor drivers. The actuators 320 apply forces to the coupled or interconnected lower or mounting surface 313 that when combined cause the panel 312 (and its upper contact surface) to vibrate. Power for the actuators 320 is provided via line 328 via high power buffering and/or energy storage 326, which may include one or more batteries and/or capacitors.

The assembly includes a controller 330 (onboard as shown or off board with simple control signals routed to a variety of panels) that may include a CPU running a control program and responding to control signals from an offboard master controller to retrieve and playback effects from a library that define operations of the actuators 320 (e.g., to create a few spaced apart large vibrations, to create a rapid sequence of weaker or smaller vibrations, and the like). The controller 330 may communicate with the offboard controller in a wired manner via line 332 or in a wireless manner via wireless transceiver/node 334 to receive control signals and/or to transmit sensor data from onboard sensors.

The onboard sensors may include components 340 for local show sensing such as for measuring force or proximity of objects relative to the upper contact surface of the panel 312, for reading radio frequency identification (RFID) tags on nearby objects, for sensing force and/or vibrations of the panel 312, and the like (with sensing force being useful to responding to a human standing statically on the panel 312). The collected sensor data may be processed locally 330 or may be transmitted for offboard processing by the show/master controller of the system with the assembly, and control signals for the drivers 324 may be generated onboard by controller 330 and/or by the offboard controller. The onboard sensors may also include components 344 for providing maintenance sensing such as to provide current and/or voltage readings and/or to measure accelerations, sound levels, temperatures, moisture, and/or the like. This maintenance data may be processed onboard (such as to have the controller 330 shutdown the assembly locally when maximum or minimum values are detected) or by the offboard show/master controller such as to turn off the assembly or to determine when a particular maintenance is required or useful for the assembly.

Figure 4:
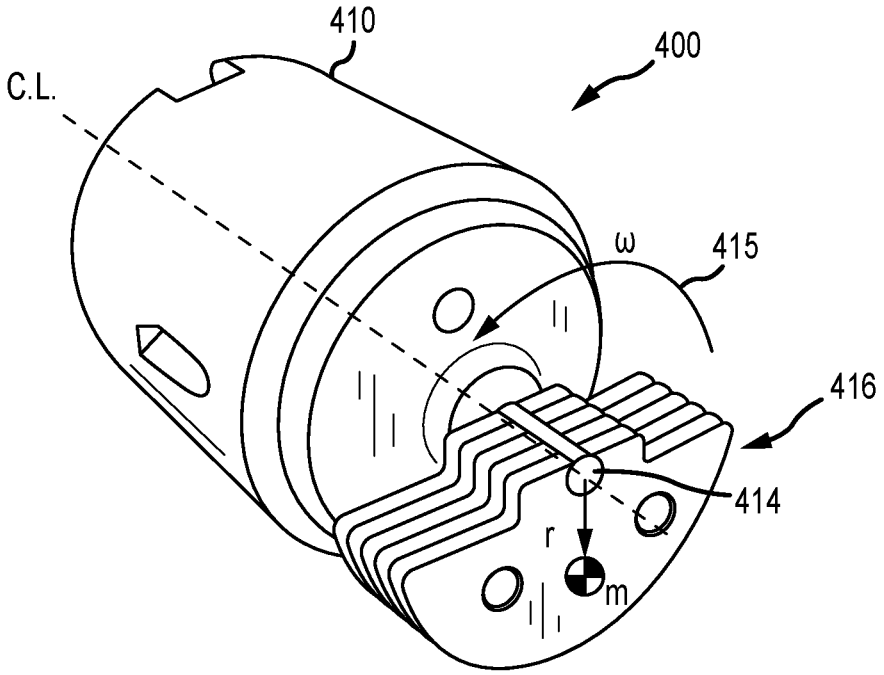
FIG. 4 is a perspective end view of a vibrator motor that may be used in an actuator of a quake plate assembly of the present description.

As noted above, the actuators 320 may take a wide variety of forms to practice the quake plate assembly. In one embodiment, each of the actuators 320 was provided in the form of a linear array of a plurality (e.g., 4 to 20 or more) of vibrator motors, which are concurrently driven to operate to vibrate the plate to which they are mounted. FIG. 4 illustrates an exemplary vibrator motor 400 that may be used in such an actuator configuration, and vibrator motor 400 includes a motor 410 operable to rotate 415 a drive shaft 414 to which an eccentric or offset mass 416 is affixed. The mass 416 is eccentric in that its center of mass does not coincide with the central axis of the drive shaft 414 but is, instead, offset a distance or radius, r, as shown in FIG. 4.

To fabricate an actuator, all the vibrator motors 400 are securely or rigidly fastened to the lower or bottom surface of a panel or plate such as with a frame supporting the drive motor 410 and allowing free rotation of the drive shaft 414 and eccentric mass 416. The frame can be configured such that the drive shafts of all the motors are coplanar or generally so and also parallel to each other, so their forces are additive in a desired manner and for ease of fabrication. The motor 410 is a brushed direct current (DC) motor in one implementation and the mass 416 provided in the form of a 0.5 ounce offset weight (although other sized weights may be used) pressed onto the drive or output shaft 414. The offset weights are small, but they are moved at high acceleration over an approximate half inch of travel such that as the mass 416 spins 415 around centrifugal force causes vibration of the plate/panel to which the motor 410 is securely/rigidly fastened (especially when all the centrifugal forces of the vibrator motors provided in the actuator are combined). Again, "centrifugal force" is intended to include forces occurring when a mass is spinning around at a constant velocity and also the brief accelerations and forces generated when the mass starts and stops spinning. The vibrator motor 410 may also be labeled an eccentric rotating mass (ERM) actuator, and it is one of the simplest and cheaper ways to provide a vibration feeling. The vibrator driver 410 typically only requires an electronic switch to operate since the rotation of the vibrator motor 410 generates the oscillating feeling itself.

The inventors have identified three major operating modes for using vibrator motors such as vibrator motor 410 within an actuator of a quake plate assembly. The first involves running the vibrator motors concurrently in each array or bank (or each actuator) at one of a variety of voltages (e.g., in the range of 0 to 8 VDC). The effect on the plate or panel can certainly be felt on the upper contact surface, but the effect may feel chaotic and noisy which may or may not be desirable. This control was used in one embodiment to provide a strong chaotic feeling. The motors all tend to operate at similar but different speeds so that one standing on or touching the upper contact surface gets a feeling of a range of frequencies many of which cancel each other out. In this operating mode, one would expect the amplitude of the vibration to increase as sqrt(N*A) when the number of motors, N, is increased while A is the vibration amplitude of a single motor on its own, and this means that one hundred motors will only feel about ten times as strong as one motor.

A second operating mode was discovered by the inventors. As they experimented, the inventors recognized that it may be useful to have all the vibrator motors work together (e.g., so that their centrifugal forces were additive when applied to the bottom or lower mounting surface of the plate/panel). In this regard, it was discovered that it was useful to operate the vibrator motors to allow the eccentric weights to settle under the force of gravity and then to only drive them for short bursts. Since the vibrator motors in this operating mode all start with their eccentric weights at the same position (e.g., with the center of mass directly below the drive or output shaft), their motions will be synchronized at least for a little while until the differences of the motors start to make them diverge. Individually, the effect of each motor is still small, but now one would expect the synchronized vibrator motors' effects to simply add as N*A instead of partially cancelling, which makes one hundred motors now almost one hundred times as big in effect as one motor.

The effect provided by this second operating mode has one notable limitation. The vibration haptic effect is incredibly strong at first but then will start to decay over about a second as the vibrator motors differences start to become important. Note that higher quality motors should stay synchronized longer due to better consistency in their manufacture. The rapid decay often is not very limiting, though, because in practice most of the effects of interest start out strong and then decay and have short duration overall. A good example is a giant's footstep near to a floor/platform of quake plate assemblies.

A third operating mode was created because it was recognized that there are some vibration effects that are long-term ambience effects like the hum of machinery, a levitating space craft, rain, wind, and the like. The motors could be mechanically coupled together with belts or pulleys for these effects, but the cost may be considered too high for some applications. For these effects, the third operating mode may be used to use gravity alignment but in a different way than the second operating mode. Particularly, instead of driving the masses around in circles and letting centripetal acceleration cause the vibration, the control signals may be used to control the drive motors to drive the eccentric mass back and forth to oscillate like a pendulum. By never letting the eccentric masses go fully around in a circle, gravity is given the opportunity on average to pull all the eccentric masses back to the same position, which makes all the motors synchronized (relative to mass location).

The behavior is more like that of a speaker using gravity as the return spring than a traditional vibrator motor. This third operating mode can in fact even be driven by audio signals if desired, but care should be taken so that the audio signals are not large enough to drive the drive motor outside of its operating range just like over-travel on speakers. Conveniently, however, in the case of over-travel, the eccentric mass will harmlessly move fully around the drive or output shaft causing the vibrator motor to briefly lose synchronization with the others in the actuator. Since this third operating mode is applying accelerations actively to the eccentric mass (instead of just driving it around in circles), the acceleration can be more interesting than simple centripetal acceleration at a frequency. Aperiodic signals, distorted sinusoids, and audio can all be played back, and it just takes more power than the rotation because direction changes need to be actively forced.

If the vibrator motor 410 of FIG. 4 is simply scaled up, one would expect stronger vibration. However, one would also expect the system to behave slower. This appears to indicate that small diameter motors may be useful in haptic floor systems in which it is desirable to have a high frequency response. As will become clear, though, fewer motors can be utilized to provide a high frequency response if an elongated eccentric or offset mass is utilized that is arranged with its central axis parallel to the drive or output shaft.

The actuators for use in the quake plate assemblies (such as actuators 320 in assembly 310 of FIG. 3) may take other forms to implement the invention. High end cell phones and video game consoles in the last few years have been transitioning to linear resonant actuators (LRAs), which are basically linear voice coils moving a mass up and down against a (sometimes very weak) spring. This, in turn, provides an equal and opposite reaction force into the body it is mounted to such as a user's hand in a handheld example. Hence, an actuator for a quake plate assembly may be formed using one, two, or more LRAs (e.g., a ButtKicker distributed by The Guitammer Company or similar device), with the LRA using an amplifier (which may be much more expensive than a simple digital switch) to drive the motion so that they are capable of nuanced effects (e.g., good low frequency response) but may not provide as strong a vibration as the actuators using eccentric masses and may have a relatively large form factor (e.g., high performance LRAs can be six inches tall).

Other devices that may be used as or in the actuator of a quake plate assembly include a full range transducer or tactile sound (such as those available from Clark Synthesis and similar producers and/or distributors), which may be relatively thin (such as about two inches thick) but may not provide much response below 50 Hertz (Hz). In other cases, the actuator may include or take the form of a motion actuator (such as those available from Crowson Technology, LLC and similar producers and/or distributors) that provide good medium and low frequency vibration effects. Some of these motion actuators push against the ground or another surface instead of against a mass, and these actuators have the benefit of having a very large effective reaction mass (e.g., the entire earth), which is especially useful for lower frequencies (such as down to around 5 Hz, which is similar to a sway of an earthquake or building) and since they are using the earth as a mass they can be quite thin (e.g., about 1-inch thick).

Figure 5:
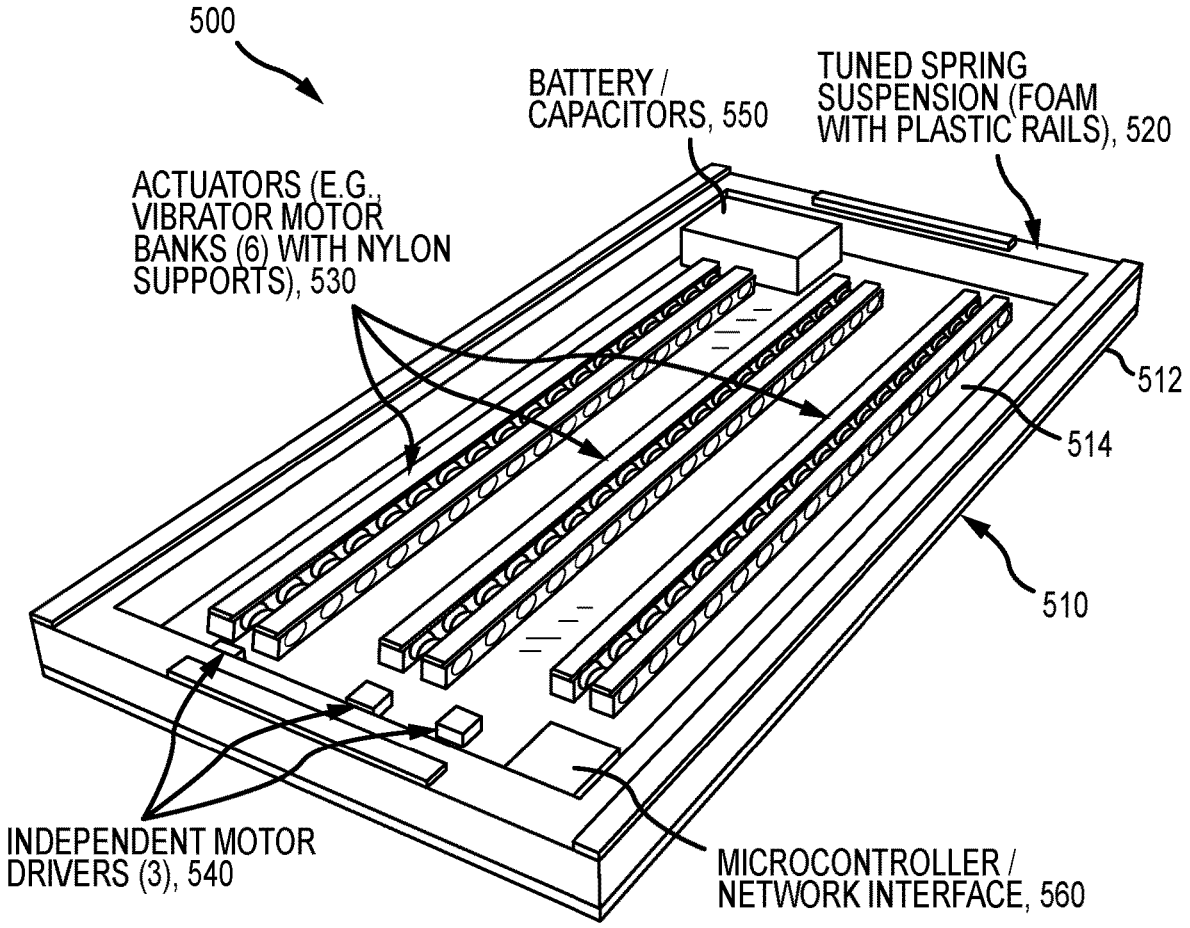
FIGS. 5 and 6 illustrates with a bottom perspective view and a bottom view, respectively, a quake plate assembly of the present description that may be used in a haptic floor system such as that of FIG. 2.
Figure 6:
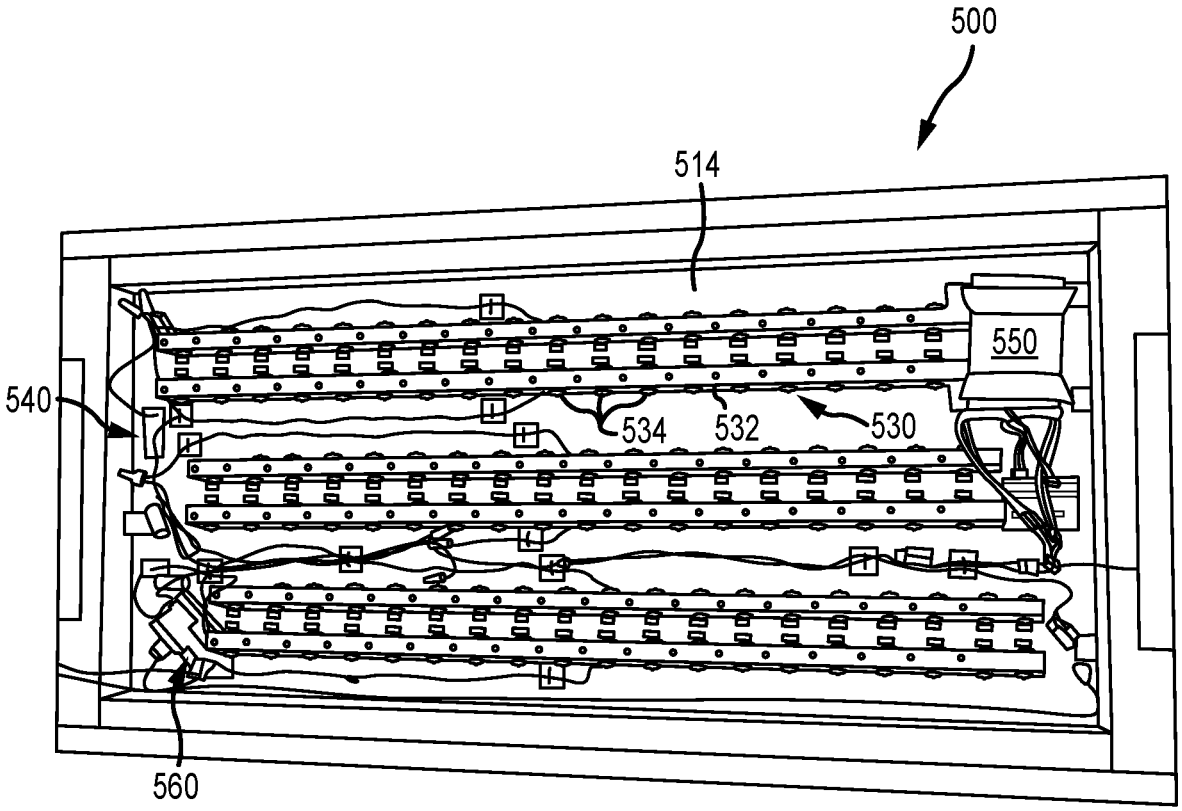

FIGS. 5 and 6 illustrate a bottom perspective view and a bottom view, respectively, of a quake plate assembly 500 that may be used with other such assemblies in a haptic floor system to provide a support platform or floor or other surface for providing a vibration-based haptic experience. As shown, the assembly 500 includes a plate or panel 510, such as a section of a metal or plastic sheet, and the panel 510 has an upper contact surface 512 for receiving a portion of a person's body and also has a lower mounting surface 514 opposite surface 512.

The assembly 500 includes a spring suspension 520 attached to the peripheral edges of the lower mounting surface 514, and the spring suspension 520 is used to enclose the actuators 530 and other assembly components. The spring suspension 520 also acts to resiliently support the panel 510 a distance above a support surface (e.g., a floor of a building, a concrete pad, the ground, a seat pad, a wall, or the like), which is not shown in FIGS. 5 and 6 but would be present in a typical installation site for a haptic floor system. The configuration of the spring suspension 520 may be chosen or "tuned" to suit a particular panel 510 (e.g., its thickness and rigidity during use) and actuators 530, and, in one useful embodiment, foam (e.g., a high density foam such as a polyurethane foam, a latex foam, or the like with plastic rails) was used for the suspension 520 (e.g., with a rectangular cross section with sides in the range of 1 to 4 inches). In other embodiments, the foam was replaced with rubber members.

The plastic rails enable the use of the stiffness of only the small part of the foam under which the rails sit but maintain the stability of the wider piece of foam and distribute force into the rest of the body of the foam once there is enough force to crush the rails into the surface of the foam in the event of too much load. The cross section of the foam is mainly about providing robustness and lateral stiffness compared to the vertical stiffness. As another note, the spring suspension 520 may often be implemented without relying on foam (which may degrade over extended use). For example, the spring suspension 520 may be implemented using springs for vertical motion along with supports that prevent the springs from letting the tile/panel 510 accidentally tip over. This may involve use of feet that bottom-out next to the springs in the event there is more force than the springs want to see like the foam above.

To allow the panel 510 to be vibrated, the assembly 500 includes one-to-many actuators. As shown, six actuators 530 are shown to be mounted onto the lower mounting surface 514 of the panel 510. Each actuator 530 is formed as an elongated bank or array of vibrator motors 534, which may take the form of the vibrator motor 400 of FIG. 4 and which are coupled to the surface 514 via a frame or support 532. The frame/support 532 may be formed of a plastic (such as nylon or the like), metal, or other rigid material and may be configured for receiving the vibrator motors, holding the drive motor portion firmly in place, and for transmitting centrifugal forces created by the vibrator motors 534 to the panel 510 via mounting surface 514.

As discussed above, the vibrator motors 534 can be synchronized by operating each drive motor in short bursts and allowing gravity to place each of the eccentric weights in a similar position or orientation, and synchronization is furthered by supporting all the vibrator motors 534 to have a similar orientation such as the one shown with all their drive shafts parallel to the lower mounting surface 514 (and to each other). Each actuator 530 includes a plurality of vibrator motors 534 such as a number in the range of 2 to 30 with 18 used in one prototype of the assembly 500, and, via synchronized operations, the centrifugal force generated by each vibrator motor 534 and applied via frame/support 532 to the panel 510 is additive to vibrate the panel 510 and the upper contact surface 512.

The assembly 500 further includes motor drivers 540 for driving operations of the vibrator motors 534 in the actuators 530. In the illustrated assembly 500, three motor drivers 540 are shown with each concurrently driving a pair of the actuators 530. The vibrator motors 534 were ganged together by parallel electrical connection into three actuator pairs that are separately controllable via drivers 540. In one preferred implementation, the motor drivers 540 are independently operable by a microcontroller/network interface 560 (such as to playback a waveform from a library stored in memory of the microcontroller/network interface 560 (e.g., an Arduino or the like) in response to a control/trigger signal from a master/show controller of a haptic floor system). In this way, each of the three pairs of actuators 530 can be selectively operated to vary the magnitude of the vibration of the panel 510, e.g., maximized when all three pairs are concurrently operated, minimized with only one pair operated, and intermediately generated with two of the pairs operated. The assembly 500 also is shown to include an onboard power source 550 such as one or more batteries and/or one or more capacitors to support the periodic use of significant amounts of power to drive the large number of vibrator motors 534 (with 108 vibrator motors 534 shown in FIGS. 5 and 6).

In the embodiment of FIGS. 5 and 6, the quake plate assembly 500 uses a large array of very low-cost motors 534. The assembly 500 produces a large amount of vibration for a relatively low fabrication cost, which may be useful for temporary installations and events but may have wear issues if used for an extended period. The vibrator motors 534 were small brushed DC motor vibrators that used low cost brushes and bushings, and both were found to wear during testing. A test plate of sixteen motors experienced one brush failure after about 500,000 high-power cycles, but wear will depend on the details of the effect pattern that is chosen. The vibrator motors were arranged into six actuators 530 arranged into three pairs driven by motor drivers 540 to allow for multiple effects to be played back at the same time while allowing time for the weights to resynchronized after each effect. It also allows for a variable magnitude at a given frequency as well as multiple concurrent frequencies or time events.

Figure 7:
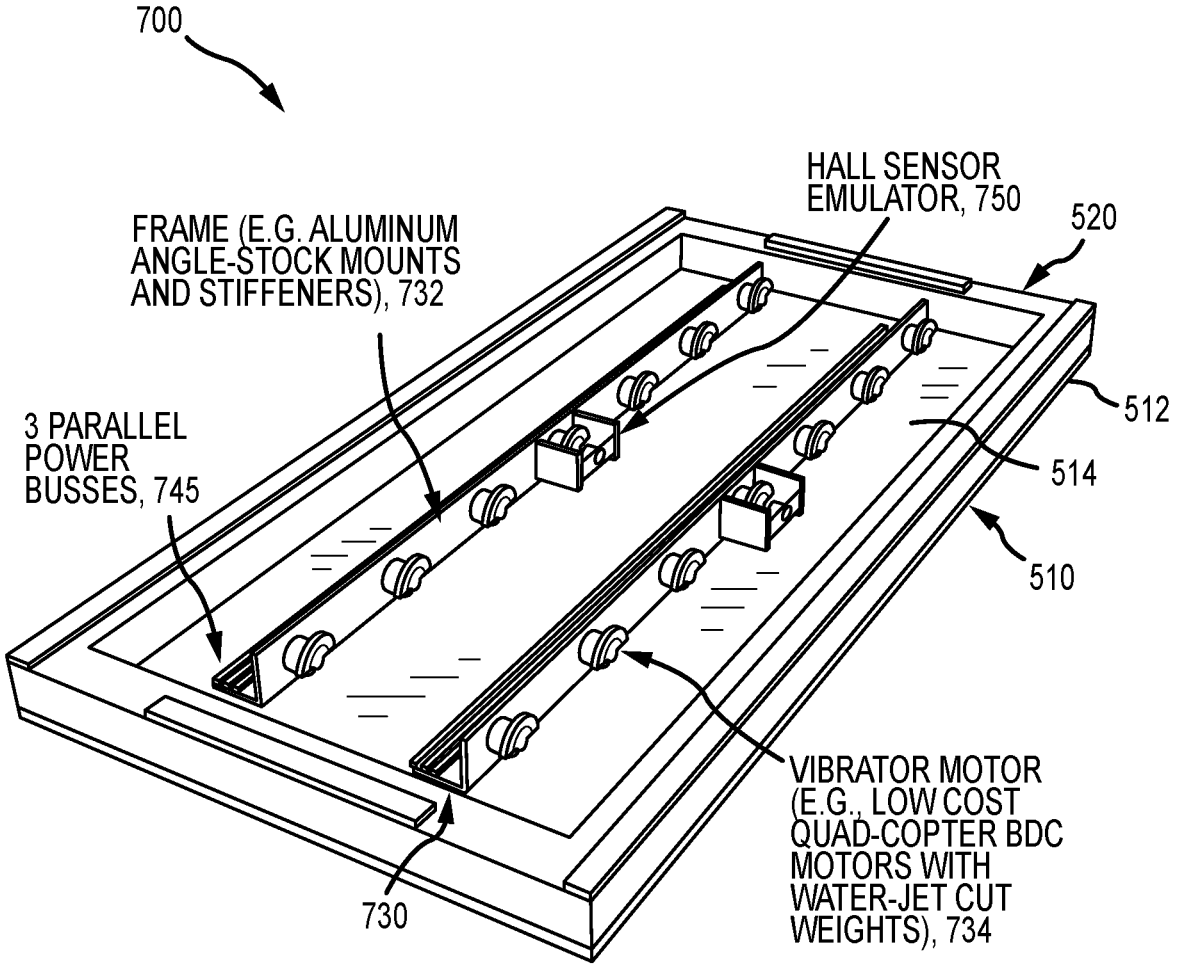
FIG. 7 illustrates a bottom perspective view of another embodiment of a quake plate assembly of the present description.

FIG. 7 illustrates a bottom perspective view of another embodiment of a quake plate assembly 700 with a similar configuration as the assembly 500 of FIGS. 5 and 6 (and like components are similarly numbered) but using fewer but larger vibrator motors 734. As shown, the assembly 700 includes two actuators 730 instead of six as in assembly 500, and each actuator 730 only includes seven vibrator motors 734 supported in a frame/support 732 (e.g., aluminum angle stock mounts with stiffeners) fastened to the lower mounting surface 514 of the panel 510. The vibrator motors 734 in each actuator 730 are concurrently operated via power supplied by three parallel power busses 745, and motor sensing is provided with an encoder on one vibrator motor 734, e.g., a Hall sensor emulator 750 may be provided on one drive motor in each actuator 730. While not shown, the assembly 700 may include a driver (e.g., an off-the-shelf RC driver or the like) that may be used to drive motors 734 in parallel in each array or actuator 730. For instantaneous response from 0 RPM, it may be desirable to provide a sensored motor, which can be provided with a sensor emulator 750 on a motor chosen as a single representative motor. This provides an improved response for this vibrator motor 734, but a small angle variability may be compounded by the large number of pole pairs, which can make the response from the other vibrator motors 734 less reliable and/or chaotic.

Figure 8:
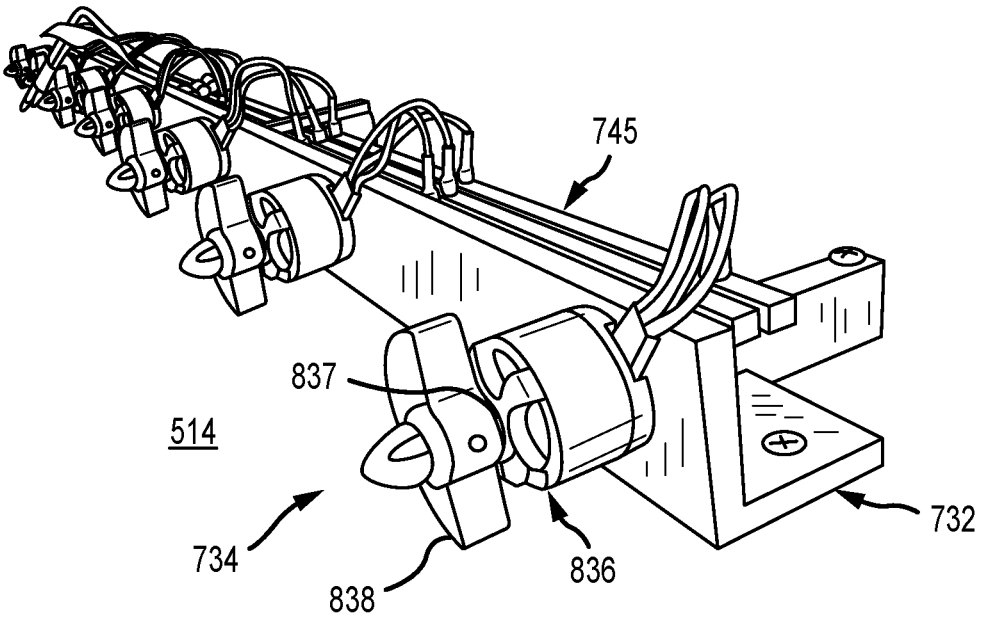
FIG. 8 illustrates a vibrator motor of one of the actuators of the quake plate assembly of FIG. 7.

As seen in FIG. 8, each vibrator motor 734 includes a drive motor 836 that rotates a drive or output shaft 837, and a mass or weight 838 is coupled to the drive or output shaft 837. The weight 838 is configured to provide an eccentric mass as its center of mass is offset a distance from the central axis of the drive or output shaft 837 such that it generates a centrifugal force when rotated about the shaft 837 that is transmitted via the frame/support 732 to the interconnected panel 510 (as the frame/support 732 is rigidly fastened to the lower mounting surface 514). In one embodiment, the drive motor 836 took the form of a low-cost quadcopter brushless DC motor, and the weight 838 was cut into the shape of a semi-circular plate (e.g., half of a circular plate).

In the quake plate assembly 700, a smaller-sized array of higher quality, medium power motors 734 is used in each actuator 730. The use of hobby brushless DC motors in the vibrator motors 734 will eliminate the problem of brush failure and may mitigate bearing wear as well due to the use of dual ball bearings. The higher cost is partly offset by the several times increase in torque that each drive motor provides, which allows the use of weights that are much heavier than provided in vibrator motors 534 of FIGS. 5 and 6. Hence, to provide the same vibration magnitude, each vibrator motor 734 can replace about seven of the vibrator motors 534. The motor driver used for each actuator 730 will also cost more than a simple brushed motor H-bridge, but the driver will likely last much longer than the drive motors and likely make service life better when compared to the brushed option.

The angular tolerance needed to maintain long term synchronization may be difficult to achieve in the assembly 700. Particularly, the inventors built a relatively simple prototype of the assembly 700, and it was discovered that synchronization was an issue to address. Having common drive lines (e.g., buss bars 745 shown in FIG. 8) provides an effective synchronization current "stiffness" to provide an actively driven phase-lock. In some cases, though, the drive motor 836 may be of a style with multiple pole pairs, which results in a handful of equally stable shaft position locations (e.g., five for the ones used in the prototype). This means that if the vibrator motors 734 do lose synchronization, they will not be able to get back to the synchronized state without some sort of extra complexity per motor. Unlike the DC motors used in the assembly 500, the extra magnetic cogging of these systems does not allow gravity to synchronize them well even with the much larger weight size (e.g., gravity provides very little restoring torque for the relatively small angles that result from a stable point slip).

Figure 9:
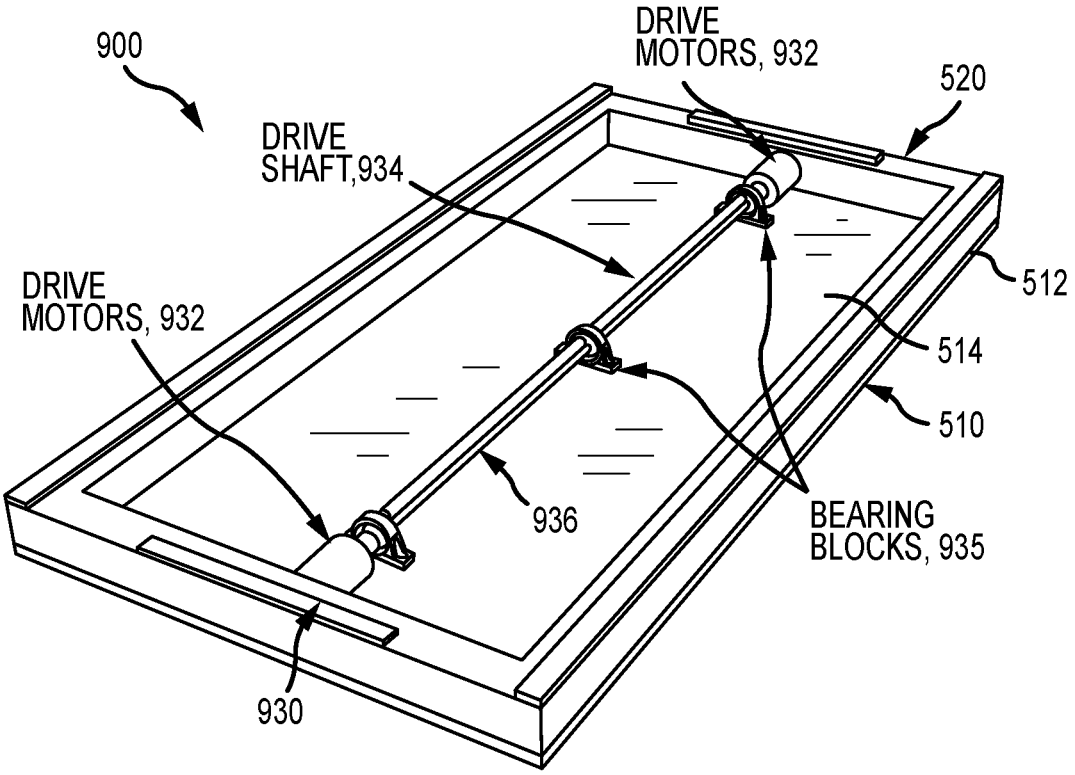
FIG. 9 illustrates a bottom perspective view of a third embodiment of a quake plate assembly of the present description using a single actuator with a single drive shaft and offset weight.
Figure 10:
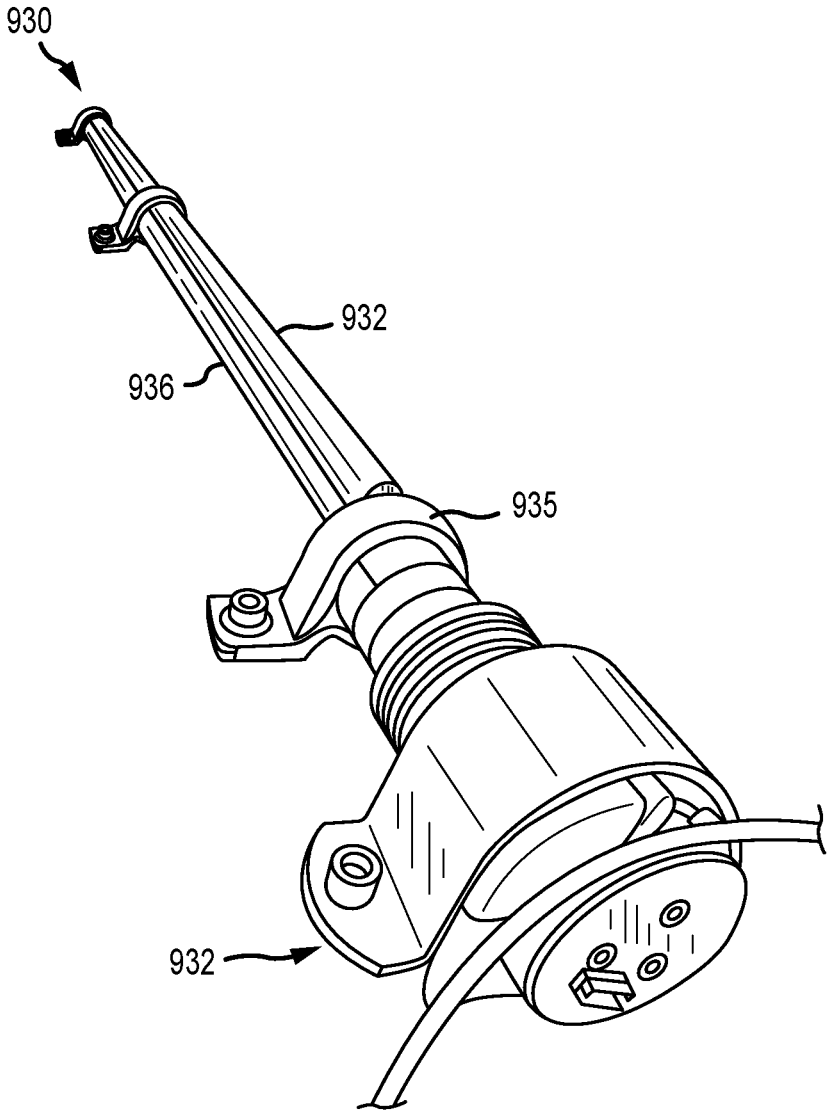
FIG. 10 illustrates the actuator of the assembly of FIG. 9 in greater detail.

FIG. 9 illustrates a bottom perspective view of a third embodiment of a quake plate assembly 900 of the present description using a single actuator 930 with a single drive shaft 934 and offset weight or eccentric mass 936, and FIG. 10 illustrates the actuator 930 in greater detail. As shown, the actuator 930 includes a pair of drive motors 932 coupled to opposite ends of the drive shaft 934 that are concurrently operable to drive or rotate the shaft 934 about its central axis. Some embodiments may use a single drive motor 932, but two provides redundancy that may be desirable in some embodiments. The actuator 930 is rigidly coupled to the lower mounting surface 514 of the panel 510 such that any vibration inducing forces generated by the actuator 930 are transmitted to the upper contact surface 512.

In the illustrated embodiment, the drive shaft 934 (e.g., 0.5-inch metal rod or the like) extends nearly the entire length of the panel 510, and it may have a length in the range of 12 to 48 inches (or more) depending on the size of the panel 510. To generate centrifugal forces that can be applied to the surface 514, an offset weight or eccentric mass 936 is attached to one side of the drive shaft 934. The weight 936 may take a variety of forms to practice the assembly 900 such as a rod (e.g., a circular or square metal rod or the like) that extends along a portion of the length of the drive shaft 934. In one prototype of the assembly 900, a 0.5-inch steel rod was used for the weight 936 with a length nearly equal to the length of the drive shaft 934, and it was attached to a 0.5-inch drive shaft 934 so that its central axis was parallel to the central axis of the drive shaft 934 and offset by a distance of about 1 inch. The weight/mass 936 can vary widely to achieve desired effects such as by being in the range of 0.5 to 4 pounds, with the prototype using a rod weighing in the range of 1.5 and 2.5 pounds. A bigger tile (one larger than the 4 foot by 2 foot tile prototyped) typically would use a weight/mass 936 that is greater/larger, and scaling up may be achieved by expressing the weight per square foot of the tile provided above.

The embodiment of the assembly 900 uses a very small number (one or two) of larger hobby motors, which were brushless DC motors. The form factor of the weight 936 was changed from the prior embodiments, and it was arranged in the actuator 930 to extending lengthwise parallel to the drive shaft 934 instead of radially. This enables the assembly 900 to use a much larger weight 936 but with a small form factor (still fitting into same or less space than other actuators to achieve the same or larger vibrations). Importantly, the design of the actuator 930 reduces the effective moment of inertia so that it keeps the bandwidth high as moment of inertia varies as M*R^2 but vibration strength goes as M*R so a larger mass, M, and small radius, R, will provide better performance (which is counter to the vast majority of ERMs). This means the assembly 900 can provide more linear vibration for a given torque and can potentially reduce the motor count as well (e.g., one motor 932 likely is sufficient). With regard to providing "more linear vibration," assembly 900 provides a higher rate of change of vibration for a given torque, resulting in a wider range of possible sensations, especially the crisp feeling effects like the pop of the "monster footstep." This also translates into better linear acceleration as in the transient seat and stop of the weight as it is driven back and forth like a pendulum such that the assembly 900 is more effective in "speaker" mode. The very long aspect ratio of the permanent reaction weight 936 maximizes performance while the actuator 930 is lower in cost than the prior two embodiments. The drive motors 932 can be replaced within minutes, and phase lock or synchronization issues are completely solved (or are simply not issues) by this actuator design.

The assembly 900, when fabricated as a prototype, proved to work well even with a single large motor 932. The weight 936 was provided by welding a 0.5-inch rod to the drive shaft 934. Both ends of the drive shaft 934, as was the middle, are supported with bearings in pillow blocks as shown at 935 in FIG. 9. An angle compensating shaft coupler was used to adapt from the smaller motor shaft to the 0.5-inch (in one non-limiting embodiment) drive shaft 934, and a rubberized pipe mount was used to hold the motors 932 in place on the surface 914 and allowed it to self-adjust when misalignments occur. The weight 936 is isolated from the motors 932 to prevent failure, and the actuator 930 can be fabricated at a relatively low cost (e.g., a prototype was fabricated for less than $100 USD). The single, large weight 936 makes synchronization completely unnecessary giving much more flexibility with haptic effects. The total height of the prototype of the embodiment of the assembly 900 of 2.5 inches was limited by the motor mounts used but could be reduced to that achieved with prototypes of assemblies 500 and 700 of 2 inches, by pocketing or use of an aluminum plate with extruded rails instead of a honeycomb plate for panel 510.

A custom motor driver was built for the actuator 930, but not shown in FIGS. 9 and 10. The motor driver was configured to give a large, unfiltered surge of current to be able to drive the motors 932 for the desired vibration-based effects (specifically, with a sensorized motor). Sensor-less commutation may not be a desired option as it takes time to find rotor signal lock, which can reduce or even ruin the big pulse effect. In one prototype, an off-the-shelf PSOC 5LP board CY8CKIT-059 with an RM M3 core integrated with a CPLD was used to sense the motor Hall Effect signals and to handle the high speed switching logic. The following were power specifications for the prototype of assembly 900: (a) maximum supply voltage of 60V; (b) continuous current limit of 200 A (400A pulsed); and (c) maximum switch frequency of 55 kHz.

With regard to the double driving embodiment shown, a single weighted shaft with motors on each end gives increased torsional rigidity (by a factor of 4) and reduced power consumption for the same torque (by a factor of 2). Synchronization between the two motors is achieved simply due to the use of a common connection to the high-bandwidth weight, and, in a case of a motor failure, there is a redundant motor. The assembly 900 can be implemented either with a single motor or with a double motor per weight with a tradeoff of power, redundancy, and initial cost. The motors used cost about $50 USD each, and the motor drivers likely would have an equal or smaller cost when mass produced. If flexing is expected on the panel 510, separating the weight assembly (e.g., the shaft 934 and eccentric weight/mass 936) into smaller portions with an angular misalignment-capable shaft coupler may be used to implement the assembly 900 and will likely increase life.

To prove the possibility of using local capacitors to reduce power supply requirements for the quake plate assemblies, the inventors tested a prototype of assembly 900 that ran off of a commercially available bank of super capacitors (e.g., 58F 15V super capacitor banks distributed by Maxwell or the like). The internal resistance was higher than may be desired such that 1F electrolytic banks in parallel may be more desirable (such as two in parallel). The −120F setup had enough energy to run a "monster step" (very large) haptic effect about five times without charging between effects. This design should dramatically reduce the size of infrastructural cable as well as power supply current capability compared to a direct plug-in option.

Figure 11:
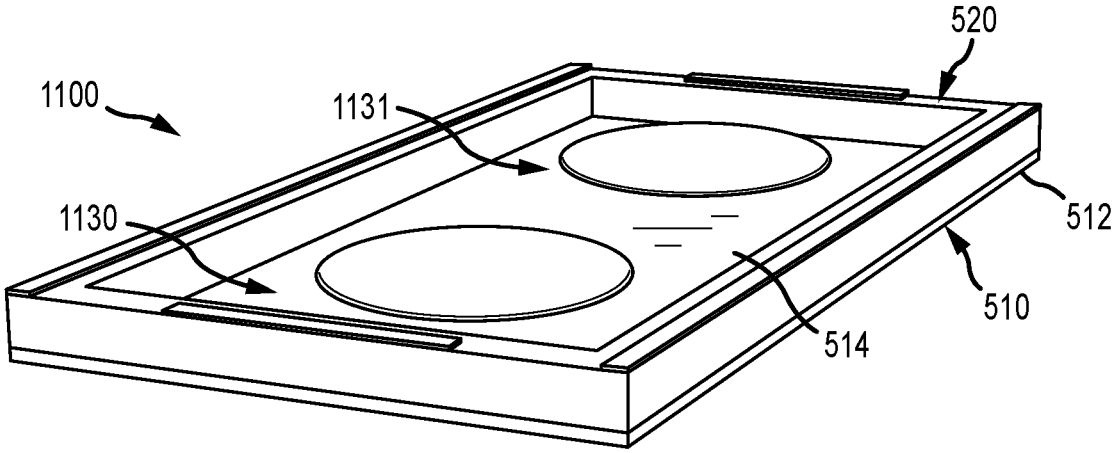
FIG. 11 illustrates a fourth embodiment of a quake plate assembly of the present description for use in haptic floor systems.

FIG. 11 illustrates a fourth embodiment of a quake plate assembly 1100 of the present description for use in haptic floor systems. In this embodiment, a pair of actuators 1130 and 1131 are mounted onto the lower mounting surface 514, and the actuators 1130, 1131 each takes the form of an off-the-shelf home theater actuator mounted to the panel 510 with tuned suspension 520. The assembly 1100, hence, is a voice coil reaction mass system that can have a particularly low profile, and the actuators 1130, 1131 (e.g., the Silver model available from Clark Synthesis, Inc. or the like) may be chosen to have a variety of strengths for different needs. Tests showed that these versions worked well for a 2-foot square plate 510 (which may be driven with a single actuator) and also for a 2 foot by 4 foot plate or floor tile 510 (e.g., with one actuator 1130, 1131 on each side or end of the plate 510).

One major advantage of the assembly 1100 is that it can playback any signal just like a speaker. Also, like a speaker, the assembly 1100 will have a maximum and minimum frequency that it can handle. The minimum frequency capability can be aided by the tuned suspension 520, with some limitations. The high frequencies should be avoided in most applications, as a subwoofer should be used to focus mostly on low notes. Some effects (e.g., gunshots, a cannon firing, and so on) should still have some high frequency in the haptics, though, so a hardware filter may not be desirable in the assembly 1100. Another potential advantage is that there is very little development needed to get the assembly 1100 into service. The parts are already commercially produced and can be purchased off-the-shelf and likely will provide a good service lifetime.

A disadvantage of assembly 1100 is the cost. The actuators used in a prototype were about $150 USD each, and the amplifiers (not shown) to drive them would add $50 to $100 to the cost of the assembly 1100. That makes the actuators 1130, 1131 and power supply for a 2 foot by 4 foot floor tile 510 about $500 USD each. Other designs, though, may be implemented to lower the fabrication cost, and the assembly 1100 may be useful in high value, high fidelity applications.

Figure 12:
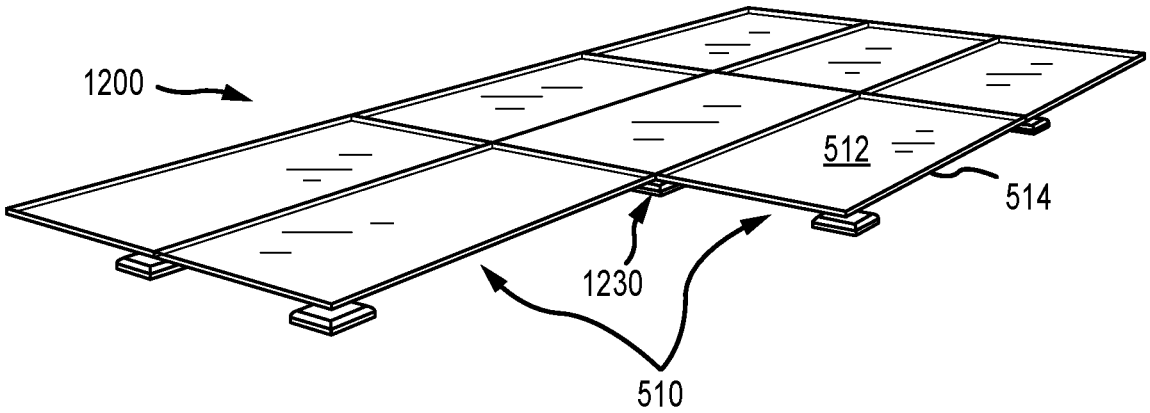
FIG. 12 illustrates another haptic floor system with a fifth embodiment of the quake plate assembly.

FIG. 12 illustrates another embodiment of a haptic floor system 1200 that is a special variant of the actuators described above in that it does not use a reaction mass but rather uses actuators 1230 that push against the ground (or other supporting surface). In other words, the actuators 1230 use the Earth itself as a reaction mass. In the system 1200 with its tessellation pattern, each actuator 1230 supports one corner of a single tile/panel 510 along with three of the neighboring tiles/panels 510. Over large areas, hence, the system 1200 approaches one actuator 1230 per tile/panel 510. The actuator 1230 itself tries to grow and shrink to move the plate/panel 510 up and down as it abuts the lower mounting surface 514. This makes it the only system described herein that can handle very low frequencies (subsonic frequencies such as 5 Hz are perceivable with system 1200), as well as other frequencies handled well by the other embodiments.

During testing of the system 1200, there was a surprising difference in perception for these low frequency signals. With the simplest effects, it was almost best described as a "disconcerting" haptic experience. There is no perceivable sound coming from the plate/panel 510 (even though it is a lower frequency that a human can hear), yet, the vibration of surface 512 was strong enough to visibly see the bodies of the test subjects on the surface 512 shake. It is likely this capability of the system 1200 may be very compelling and desirable in certain applications. If properly synchronized to media and environmental effects, though, it may be exciting. It provides the ability to give people a sensation that they might not even guess is coming from something mechanical since it is so slow. The frequency can be low enough that breathing or similar haptic effects are possible as is the sensation of floating on the ocean or in an aircraft.

A disadvantage with system 1200 again may be its high cost. The actuators 1230 used in the prototype of system 1200 cost $300 each, and stronger power amplifiers are used than in the other embodiments. The actuators 1230 tended to get hot after a few seconds of low frequency use, so the system 1200 may need to be operated to ensure the effects include time to cool down the actuators 1230. Both of these issues can be addressed in part by the addition of spring counterbalances that can share load with the actuators 1230 instead of directly lifting the people on the surfaces 512. During testing, good effects were obtained with four actuators 1230 per plate/panel 510, but that number could be reduced to nearly one per plate/panel 510. The impedance of the actuator 1230 is unfortunately high (e.g., 6 to 8 ohms) meaning low-cost 12V car amplifiers or the like may not be suited for system 1200 but, instead, an amplifier that puts out 100 volts AC may be desirable. The actuators 1230 may be chosen to each support and lift 250 pounds each, but since humans can more densely apply their weights to the panels 510 it may be useful to include spring/suspension elements for load sharing.

Testing was performed of the operations of the quake plate assembly shown in FIGS. 5 and 6 in a haptic floor system. To characterize the magnitude and feel of this system, two accelerometers were installed onto the panel/plate in both the center and the halfway point along the 2-foot edge of the panel/plate. All channels of the two analog ADXL335 tri-axis accelerometers were recorded concurrently using an 8-channel oscilloscope triggered by the motor PWM control line for consistency (PWM and DIR were also recorded for future reference). The "monster step" effect was chosen for recording, as this vibration-based haptic effect formed the basis for a large number of the effects that the inventors have developed and tested to date.

Figure 13:
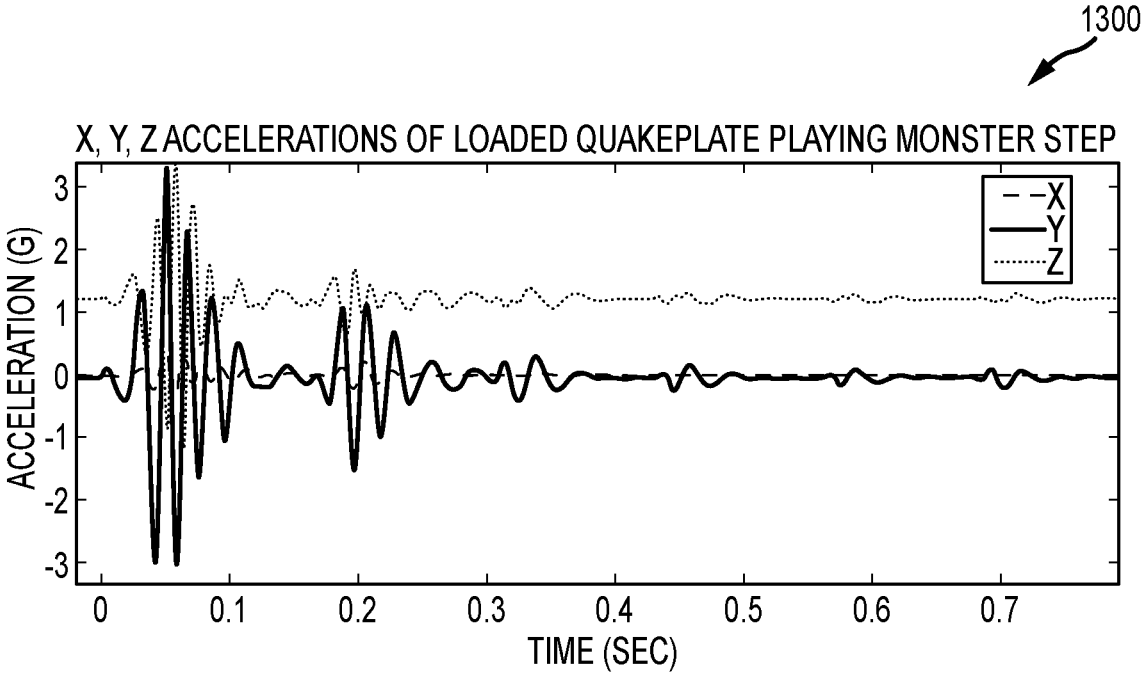
FIGS. 13-15 are graphs of X, Y, and Z accelerations showing test results for a prototype of the quake plate assembly shown in FIGS. 5 and 6.

Results for the XYZ accelerations in the center of the human-loaded quake plate are shown with graph 1300 of FIG. 13. The graph 1300 shows accelerations from the quake plate assembly of FIGS. 5 and 6 when playing the first six pulses from the monster step effect loaded with a human in the center of the plate. The dominant acceleration appears to be in one in-plane axis, with the vertical axis smaller by a small amount, and this is also close to the maximum rated acceleration of the sensor in this axis. The maximum frequency is about 70 Hz for this haptic effect. Other effects likely moved up to three times faster (at most). The Z offset is due to static gravity in that axis.

Figure 14:
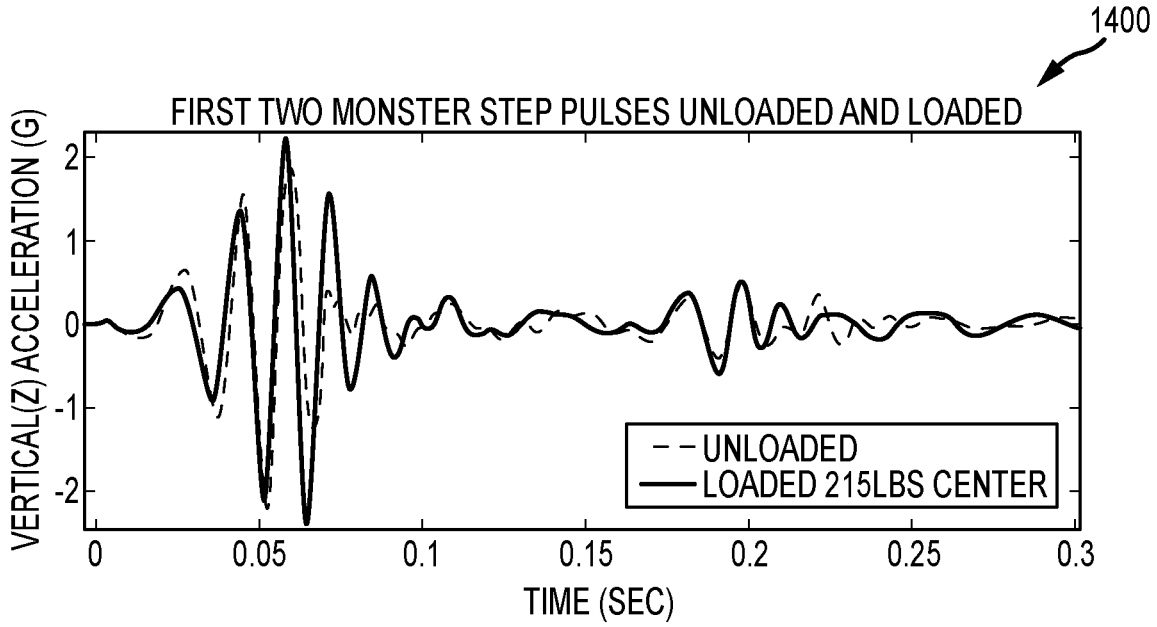

The question of importance of weight distribution on a panel/plate was considered, but, from a "feel" perspective, it did not seem to matter much whether there was one person or two on the same panel/plate. Some measurements were taken to verify this intuitive result. Specifically, data was gathered in the center of the quake plate with and without a 215-pound adult male standing directly above the sensor. The results, in graph 1400 of FIG. 14, show very little difference in acceleration for this worst case difference. The graph 1400 shows accelerations from the assembly of FIGS. 5 and 6 when operated to play the first two pulses from a monster step effect when empty and with a human at the center of the plate on upper contact surface. The rise time and amplitude do not change much at all, but one can see a small shift in a resonant frequency in the loaded case perhaps making low frequencies feel stronger with more load (note, Z axis signals were zeroed to remove static gravity signal).

Figure 15:
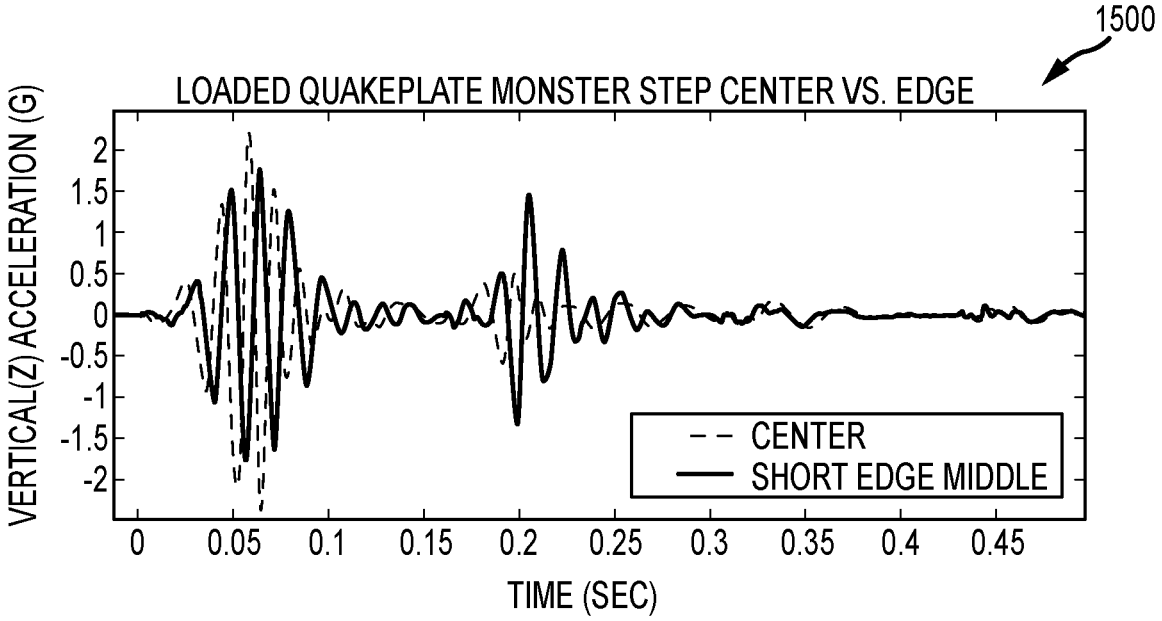

The human-loaded quake plate assembly seems to have a slightly increased resonant response, which makes sense as the assembly will have a lower resonant frequency under load. This is good from a show/experience consistency standpoint, and it also means that the weight of the assembly could matter more than the weight of the person on the panel/plate such that keeping the assembly relatively low in weight may be desirable. A next question may be from a consistency standpoint whether it matters if a single person is at the center or at the edge of the panel/plate. With this question in mind, the inventors tested the least and most supported areas of the panel/plate with results shown in graph 1500 of FIG. 15. Graph 1500 shows accelerations from the assembly of FIGS. 5 and 6 when playing the first three pulses from the monster step haptic effect. While the phase difference indicates the possibility of a resonance, the signal magnitudes are surprisingly similar considering this is a comparison of the most and least supported parts of the panel/plate with a 200-pound person standing directly on the least supported part (note that signals were zeroed to remove static gravity signal). In graph 1500, there does appear to be some difference, but it is likely not enough to change a person's perception much.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

In one useful prototype of the quake plate assembly 500 of FIG. 5, the assembly was formed by mounting to the bottom of a stiff panel, supported by springy foam, six rows of vibrator motors. Pairs of the rows were driven as 3 independent banks or actuators using three high-current motor drivers. In this tested prototype, each of the plates housed a lithium polymer battery that provided local, high current power for the drive motors. Each plate received signals from a central (Arduino-based) low-level controller, which was in turn configured for playing out haptic effects synchronized to an AV signal using serial messages from a host computer. Wireless commands were also sent and received from radio systems attached to props and wired to the master controller.

The plates were 2 feet by 4 feet and weighed approximately 20 pounds. Each plate was formed of ½-inch thick aluminum honeycomb panel, and each plate includes a suspension in the form of a 2-inch wide by 2-inch tall boarder of foam rubber (e.g., plastizote or "Zote" such as that available from Zotefoams or the like). The foam was laminated with contact adhesive and bonded to the aluminum panel with a hot melt adhesive. Finally, a 1-inch wide strip of ⅛-inch plywood was bonded along the bottom edge of the foam to serve to control the exact area of foam contact for an increase in stability and a decrease of stiffness of the overall system. The final configuration of the plywood strip was tuned for feel but also to allow simple wire access.

In the prototype of assembly 500, 108 vibrator motors were used that were arranged in three separate banks or actuators, each including two rows of eighteen vibrator motors each in the long direction of the plate or panel. All the drive motors in a bank/actuator were connected in parallel, and each independent bank/actuator was driven by a motor driver. The motor drivers received their TTL-level signals over a dedicated wire line, with 6 TTL signal lines arriving at each plate or panel, i.e., two per bank/actuator. The motors used were sourced from All Electronics, but they are the kind that are mass produced in huge quantities so can be obtained from many sources. The drive motor itself was a 0.9-inch diameter "toy" motor rated for 4.5V operation and a winding resistance of about 10 ohms. The vibrator motors are distributed with a weight/eccentric mass already pressed onto its drive/output shaft. For the prototype of assembly 500, eighteen vibrator motors were clamped into a custom (e.g., water jet cut) plastic rail affixed to the lower mounting surface of the plate or panel and holds the vibrator motors using a screw-down clamp on the top of each row.

The leads were all aligned and keyed in place in the back allowing a single piece of uninsulated buss wire to pass along the entire bank/actuator of "+" and "−" leads with a simple solder connection for each. It proved helpful to make sure that there is an extra bend of wire between all the junctions to provide slack for any motion that might need to happen without breaking the joints. This was a primary failure mode of the tested prototype run for about two weeks or about a half million cycles. A fast swapping system may be useful in future implementations of the assembly 500 as motors are expected to wear and need replacement. The motors have "+" and "−" labels on their terminals, but the motors were driven in both directions for the implemented effects. Since polarity determines direction of rotation, care should be taken to ensure that all motors are installed consistently and correctly. Banks that face in opposite directions may need to have a swapped polarity to make sure the motors from opposing banks do not cancel each other out. There may be a MTBF impact from the preferred direction of rotation depending on the design of the motors. The ones used for the initial prototypes had a rotational asymmetry in geometry of the brushes themselves, and it is possible for motors to have a preferred direction of rotation due to possible adjustments in the offset angle of the commutation.

The three motor drivers used per assembly were sourced from Pololu (e.g., Pololu G2 High-Power Motor Driver 24v21). They received TTL (Hi/Lo) motor direction and PWM speed controls and can operate with input DC voltages up to 35 volts to provide bidirectional output currents of up to 21 amps continuously without heat sinks. The assembly may be operated using short bursts (e.g., less than about 20 milliseconds (ms) such as about 10 ms bursts) of up to 60 amps. The drivers used the aluminum plate/panel as a heatsink and were modified for higher maximum current before an internal current-limiting chopper drive activates by adding a 120K resistor between reference voltage, Vref, and ground, Gnd, and cutting the trace for the existing sense resistor on the bottom of the board immediately next to those pins. A 3300 g electrolytic capacitor was also added to the "+" and "−" sockets per the manufacturer recommendation, and this has made the boards more robust in service.

With regard to batteries and the charge system, the assembly 500 used two batteries connected in series with a "Y" cable. Each battery was a 14.8V LiPo-based pack with a 5 Amp*hr capacity and a discharge rating of 50 C for a total source capability of about 250 Amps (e.g., a Lectron Pro 5.2 Ah, PN #4S5200-50S). A 40 Amp ATO fuse was included in line with the battery. Even though this 40A rating is substantially under the peak current draw of −180 Amps, it was found to not blow under intentionally rendered effects (all of which were short bursts, much faster than the time delay of the fuse) while still giving an appropriately quick response to protect the system in case of accidental triggering. Putting the fuse on the plus line could mitigate issues with the motor driver and external logic levels.

Since it may be difficult to access the undersides of a group of quake plate assemblies in a floor system, it is preferable in some applications to be able to charge the system from outside each quake plate assembly. This may be done using a series of power supplies with both voltage and current limits and running the power outputs through RJ45 or similar cables to all the quake plate assemblies in parallel. Since any two batteries will have slightly different charge states, it is useful to be able to charge them independently to make sure they stay balanced. One way to do this is with two power supplies, one for ground to 17.4V (4.2*4)+0.6V for a protection diode discussed below, and another for 17.4V to 34.8V. Both are floating ground supplies connected in series, with the ground, the middle and the top voltages sent to the quake plate assemblies.

The outputs from this charge system are wired into the quake plate assembly after the fuse and include three wires: one to battery ground; one to the center tap of the "Y" cable; and one to the most positive voltage cable. To prevent batteries from back-charging each other (rapidly and undesirably), a diode was placed in the high voltage and ground sides to only allow net current into the batteries. The center line does not need a diode since both plus and ground sides are protected, and it takes very little current (e.g., only takes as much as the charge current imbalance between the high and low cells). The diode voltage drop needs to be added to the total charge voltage for both supplies and also means that batteries that are most drained get charged first, which is a good idea for a system with a charger that is not very fast. The cables used (i.e., Cat6 cables) had a current limit of 0.5 amps per conductor, so a 2.5 A pptc ("polyfuse") was added to each output channel of a power distribution board for both the high and low voltage lines (for each quake plate assembly or plate/panel) which prevents overheating. This is far below the charge limit of the batteries (that can handle over 10 amps for charge). To maintain balance between the cells of the packs, a self-contained battery balancing board (e.g., a "Blinky" from Astro Flight or the like) can be plugged into each battery and kept there while in active use.

With regard to processors and logic used in the controller(s) of the floor system, an Arduino Mega was used to serve as the master controller for a haptic floor system that was prototyped by the inventors. It had a serial connection to another computer (e.g., a laptop, a notebook, pad, or the like), such as via a USB connection, that was used to control media playback. A processing script played back video and sound as well as artificial video screen "bounce" (to simulate "quaking" events over the entire area). In some cases, the video playhead time was used as the trigger for haptic, sound, and onscreen effects, while in other cases the quake plate assemblies and their sensors and/or other system wireless sensors served as the master to trigger visual and sound effects dynamically.

In present implementations, all haptic effects were represented in software in the form of C code while some implementations may use a library of waveforms or sound files. The use of code added flexibility in that effects can be algorithmically generated in response to measurements, time, or other inputs, but it can make "effect" development somewhat more difficult. As such, the software system preferably is configured to help the user make use of many simple building blocks to put together a library of useful effects that can be parameterized and modified for a variety of applications. For example, a randomized rain/hail effect was developed as a proof of concept, and this effect can be reused with wildly different parameters for the low frequency chaotic rumble effect (e.g., a boulder rolling nearby to the quake plate assemblies).

Early versions of the floor system were configured to play back a script with one effect playing at a time (implemented with blocking code), but later versions provide more layered and/or textured effects. To this end, an event-driven version of the controller code was built that is not thread-blocking and can drive three motor banks independently and play back three different effects on each with different time scales, for instance: (a) tick—short impulsive events (clock ticking, hail, rain, footsteps, metal-on-metal contact, and the like); (b) pulse—larger impulsive events (giant footsteps, rocks crashing, and so on); and (c) ramp—longer and smoother events (decay after a pulse simulating a falling boulder, throbbing bass from a levitating spaceship, rumble building to a crescendo, low frequency earthquake, and the like). These building blocks take in parameters such as pulse magnitude, pulse peak time, pulse deceleration magnitude, pulse rise sharpness, pulse brake sharpness, ramp time, ramp peak multitude, ramp peak time, decay time, and the like and can define dramatic effects. An effect designer/builder can then layer the effects across their own time scales and across numbers of motor banks/actuators as well. For example, "pulse all" can be used to fire a pulse on all three banks/actuators, which would still allow a tick to happen concurrently on a first bank/actuator and a ramp on a second bank/actuator as well.

The controller can also control the quake plate assemblies using effect scripts. These effects are often set to loop at a programmed rate (sometimes random) and fire off a sequence of effects. One example is a "monster step" script. The idea is to generate a decaying series of pulses that feels like a reverberating haptic echo of a giant seismic event. The effect takes a series of parameters to determine its ultimate feel (initial magnitude, reverb time rate, reverb decay rate, pulse sharpness, pulse breaking sharpness, and minimum value for cutoff) allowing one to use the same function to generate effects ranging from giant footsteps on rock or sand, metallic robot steps on metal, cannon shot, boulders crashing, spaceships landing, a character striking the floor/ground with a weapon, and so on. These variations of effects are quite useful as they are informed by physics that are repeated quite often by things that would make sense to cause a large vibration. Other already-generated effect scripts created by the inventors include: clock tick; rain/hail; laser blasts; horse trot; soldiers or crowd marching; throbbing levitation/space engine; force-grab rumble; and boulder rolling/rumble.

Another step taken by the inventors was to develop more specific effects that match pre-recorded sound effects such as a giant's walking from a movie clip, doors opening and closing, and even a voice or music. For these effects, the inventors plotted the sound effect magnitude as well as the low pass version of the same and identified time stamps that could correspond to the starting or stopping of some effect blocks like pulses and ramps at transitions or the start or end of sounds. Sometimes a loop was run for a periodic or repeating simple effects (e.g., the staccato of the monster's voice or the like). Algorithmic effect scripts may also be useful in creating these effects as many sounds are based on physics like an exponential decay or a varying amplitude rumble. In some prototypes, a serial command from the computer running the processing code sends a 0-255 byte and a simple function on the Arduino Master parses the command and triggers the corresponding effect. When a wireless sensor triggers a command, the Arduino Master sends a byte back to the processing code over serial that triggers the playback of a Quicktime audio file (found to be low latency) or other event such as camera shake or screen flash.

In some embodiments, the sensors used to drive the quake plates may be provided in wearable items. For example, a person may wear a "gesture glove" and portray a character from a movie or the like. The character may gesture to a particular participant(s) among a group of people supported on the haptic floor provided by upper surfaces of the quake plate assemblies. Then, depending on where the gesture glove is pointed and the actual gesture (for instance a "beckoning" gesture), only the area under and/or near, the pointed-to participant will vibrate with earthquake-like ferocity.

Hence, it will be clear that the haptic floor system of the present description may make use of a gesture-detecting system (that may be in the form of a glove) or any pointing/selection method which is able to connote a specific area, or areas, to receive an effect (e.g., a "magic wand" that is pointed at an area or a spotlight that illuminates the focused-upon area(s)). In another example, the haptic floor system may use the detection of an area where a laser beam has hit, for instance a faux laser beam hits the upper surface of a quake plate assembly (or a supported participant) in a certain area of the floor system, and then in that area and its surrounds, the ground shakes, coupled with simultaneous sound/lighting/video and/or other coordinated effects. In some embodiments, a person in a virtual reality (VR) head-set stands or walks on the quake plates, and the haptic floor system is controlled so that their local physical experience is coupled to what they should feel at that exact spot in the VR world provided by the VR head-set.

As discussed above (e.g., with reference to FIG. 5), the tuned spring suspension (e.g., element 520 in FIG. 5) may take the form of a set of durable springs. Foam is only ever temporary, especially outdoors in the heat and weather, such that springs or rubber members may be used instead of foam. While not shown, one skilled in the art will understand that each of the four foam members of the suspension 520 shown in FIG. 5 can be replaced by one, two, three, or more coil springs (metal or other materials) with one end abutting and/or attached to the underside or lower surface 514 of the panel/tile 510.

Over-travel stops can be provided such as in the form of legs at the corners of the panel/tile 510 and/or that are provided along the edges of the panel/tile 510. At rest, the springs typically will have a height/length such that one end will extend outward some distance past the ends of the over-travel stops to allow them to compress some distance when loaded and during operations of the quakeplate assembly and with travel/compression limited by the over-travel stops. The over-travel stops are configured to provide tipping stability and crush protection for the hardware (e.g., actuators 530, battery/capacitor 550, controller 560, and the like) if assembly 500 is overloaded. Instead of coil springs, the spring suspension 520 may utilize leaf springs or bow springs, which have much more shear stability. For example, a suspension 520 using coil springs may benefit from inclusion of a linkage, a guide, or a rail to make sure it does not fall over the wrong way in the shear direction while still allowing the vibrations to make it able to move freely for small amplitudes. In contrast, leaf and bow springs get this functionality for free in the length direction and can be tuned in the other direction as well to let the vibrations happen.

We claim:

1. A haptic floor system adapted to provide a vibration-based haptic experience, comprising:

a master controller; and a plurality of quake plate assemblies, each of the quake plate assemblies comprising:

a plate with an upper contact surface and a lower mounting surface opposite the upper contact surface, and at least one actuator mounted on the lower mounting surface and operable to apply forces to the plate to cause the upper contact surface to vibrate, wherein, in response to a sensed event, the master controller generates and transmits control signals to the plurality of quake plate assemblies to independently trigger operations of the plurality of quake plate assemblies to sequentially or concurrently operate to apply the forces to concurrently or sequentially vibrate the upper contact surfaces of the plurality of quake plate assemblies, and wherein the at least one actuator comprises at least one voice coil motor (VCM).

2. The system of claim 1, further comprising a sensor sensing and generating sensor output in response to at least one of movement of a person relative to the upper contact surfaces, movement of a prop relative to the upper contact surfaces, and contact of an object with one of the upper contact surfaces and wherein the master controller processes the sensor output to identify the sensed event.

3. The system of claim 2, wherein each of the quake plate assemblies includes a local controller and memory storing a library of haptic effect definitions and wherein the local controller, in response to receipt of one of the control signals, retrieves one of the haptic effect definitions and operates the actuator to apply the forces to the plate.

4. The system of claim 1, wherein the sensed event comprises a display playing a video or an audio system playing a soundtrack and wherein the actuators are operated based on a haptic event script or set of code associated with the video or the soundtrack to provide a haptic experience matched to the video or the soundtrack.

5. The system of claim 1, wherein the actuator comprises a plurality of the VCMs each configured as a linear resonant actuator (LRA) operable to move a mass up and down against a spring.

6. The system of claim 5, wherein each of the quake plate assemblies comprises second and third ones of the actuators, a driver for each of the actuators, and an onboard power storage for operating the VCMs and wherein the actuators on each of the quake plate assemblies is independently operable.

7. The system of claim 5, wherein the actuator comprises a linear frame supporting the plurality of the VCMs arranged to be parallel, wherein the frame is rigidly coupled to the lower mounting surface, and wherein the plate comprises a planar sheet of rigid material.

8. The system of claim 5, wherein the VCMs are operated in short bursts to provide synchronization.

9. An apparatus for providing a vibration-based haptic experience, comprising:

a plate with an upper contact surface and a lower mounting surface opposite the upper contact surface;

an actuator coupled to the lower mounting surface, wherein the actuator includes at least one linear resonator actuator (LRA) operable to cause the plate to vibrate; and a controller generating control signals to trigger operations of the actuator to vibrate the upper contact surface and provide the vibration-based haptic experience.

10. The apparatus of claim 9, further comprising an energy storage device mounted to the lower mounting surface for powering operations of the actuator and an actuator driver mounted to the lower mounting surface driving operations of the actuator in response to the control signals from the controller.

11. The apparatus of claim 10, further comprising a library of haptic effect definitions accessible by the controller and wherein the control signals are generated based on at least one of the haptic effect definitions.

12. The apparatus of claim 9, wherein the actuator comprises a plurality of the LRAs each operable to move a mass up and down against a spring.

13. The apparatus of claim 12, wherein the actuator comprises a linear frame supporting the LRAs arranged to be parallel, wherein the frame is rigidly coupled to the lower mounting surface, and wherein the plate comprises a planar sheet of rigid material.

14. The apparatus of claim 12, wherein each of the LRAs is independently operable and uses an amplifier to drive motion of the mass.

15. The apparatus of claim 9, wherein the controller generates the control signals in response to data from a virtual reality (VR) device in use by a person positioned on the upper contact surface and wherein the vibration-based haptic experience is coordinated with a VR experience concurrently provided to the person by the VR device.

16. A haptic floor system adapted to provide a vibration-based haptic experience, comprising:

a master controller; and a plurality of quake plate assemblies, each of the quake plate assemblies comprising:

a plate with an upper contact surface and a lower mounting surface opposite the upper contact surface, and at least one actuator mounted on the lower mounting surface and operable to apply forces to the plate to cause the upper contact surface to vibrate, wherein, in response to a sensed event, the master controller generates and transmits control signals to the plurality of quake plate assemblies to independently trigger operations of the at least one actuator of each of the quake plate assemblies to sequentially or concurrently operate to apply the forces to concurrently or sequentially vibrate the upper contact surfaces of the plurality of quake plate assemblies, and wherein each of the quake plate assemblies includes a local controller and memory storing a library of haptic effect definitions and wherein the local controller, in response to receipt of one of the control signals, retrieves one of the haptic effect definitions and operates the actuator to apply the forces to the plate.

17. The system of claim 16, wherein the at least one actuator comprises one or more full range transducers or one or more motion actuators.

18. The system of claim 16, wherein the at least one actuator comprises one or more LRAs.

19. The system of claim 18, wherein each of the quake plate assemblies comprises second and third ones of the actuators, a driver for each of the actuators, and an onboard power storage for operating the LRAs and wherein the actuators on each of the quake plate assemblies is independently operable.

20. The system of claim 16, wherein the master controller generates the control signals in response to data from a virtual reality (VR) device in use by a person positioned on one of the upper contact surfaces and wherein the vibration-based haptic experience is coordinated with a VR experience concurrently provided to the person by the VR device.

* * * * *